US008961296B2

(12) United States Patent
Walker

(10) Patent No.: US 8,961,296 B2
(45) Date of Patent: Feb. 24, 2015

(54) RE-CHARACTERIZATION OF BETS AT TABLE GAMES

(75) Inventor: Jay S. Walker, Ridgefield, CT (US)

(73) Assignee: Walker Digital Table Systems, LLC, Stamford, CT (US)

( * ) Notice: Subject to any disclaimer, the term of this patent is extended or adjusted under 35 U.S.C. 154(b) by 879 days.

(21) Appl. No.: 12/255,222

(22) Filed: Oct. 21, 2008

(65) Prior Publication Data

US 2009/0170595 A1 Jul. 2, 2009

Related U.S. Application Data

(63) Continuation-in-part of application No. PCT/US2008/054146, filed on Feb. 15, 2008, which is a continuation-in-part of application No. 12/092,548, filed on Aug. 21, 2008.

(60) Provisional application No. 61/024,827, filed on Jan. 30, 2008, provisional application No. 61/023,290, filed on Jan. 24, 2008, provisional application No. 61/020,470, filed on Jan. 11, 2008, provisional application No. 61/012,230, filed on Dec. 7, 2007, provisional application No. 60/943,171, filed on Jun. 11, 2007, provisional application No. 60/890,328, filed on Feb. 16, 2007, provisional application No. 61/028,558, filed on Feb. 14, 2008, provisional application No. 60/917,196, filed on May 10, 2007, provisional application No. 60/939,263, filed on May 21, 2007, provisional application No. 60/990,165, filed on Nov. 26, 2007, provisional application No. 61/014,299, filed on Dec. 17, 2007, provisional application No. 61/031,125, filed on Feb. 25, 2008, provisional application No. 61/044,249, filed on Apr. 11, 2008.

(51) Int. Cl.
*G07F 17/32* (2006.01)
*G07F 1/06* (2006.01)

(52) U.S. Cl.
CPC *G07F 1/06* (2013.01); *G07F 17/32* (2013.01); *G07F 17/322* (2013.01)
USPC ..... 463/25; 463/21

(58) Field of Classification Search
USPC ..... 463/21, 25
See application file for complete search history.

(56) References Cited

U.S. PATENT DOCUMENTS 3,556,531 A 1/1971 Elder
3,770,269 A 11/1973 Elder (Continued)

FOREIGN PATENT DOCUMENTS

AU 2007231813 11/2008
WO WO 99/10849 8/1998

OTHER PUBLICATIONS

Office Action for U.S. Appl. No. 12/092,548, mailed Mar. 18, 2011, 12 pp.

(Continued)

*Primary Examiner* — Bach Hoang
(74) *Attorney, Agent, or Firm* — Fincham Downs, LLC; Magdalena M. Fincham, Esq.

(57) ABSTRACT

A gaming table allows late bets and bet re-characterizations to increase the action available to the player during a single game instance. Such late bets and bet re-characterizations are tracked through the use of an additional token associated with the wager stack of the player.

8 Claims, 18 Drawing Sheets

(56) References Cited

U.S. PATENT DOCUMENTS

| | | | | |
|---|---|---|---|---|
| 3,834,712 | A | 9/1974 | Cox | |
| 4,648,600 | A | 3/1987 | Olliges | |
| 4,695,053 | A | 9/1987 | Vazquez et al. | |
| 4,814,589 | A | 3/1989 | Storch | |
| 4,856,787 | A | 8/1989 | Itkis | |
| 4,861,041 | A | 8/1989 | Jones et al. | |
| 5,098,107 | A | 3/1992 | Boylan et al. | |
| 5,248,142 | A | 9/1993 | Breeding et al. | |
| 5,265,882 | A | 11/1993 | Malek | |
| 5,275,416 | A | 1/1994 | Schorr et al. | |
| 5,280,915 | A | 1/1994 | Groussman | |
| 5,283,422 | A | 2/1994 | Storch | |
| 5,342,049 | A | 8/1994 | Wichinsky et al. | |
| 5,367,148 | A | 11/1994 | Storch | |
| 5,390,934 | A | 2/1995 | Grassa | |
| 5,511,781 | A | 4/1996 | Wood et al. | |
| 5,544,893 | A | 8/1996 | Jones | |
| 5,566,946 | A | 10/1996 | Parker | |
| 5,570,885 | A | 11/1996 | Ornstein | |
| 5,615,888 | A | 4/1997 | Lofink et al. | |
| 5,632,485 | A | 5/1997 | Woodland et al. | |
| 5,651,548 | A * | 7/1997 | French et al. | 463/25 |
| 5,735,742 | A * | 4/1998 | French | 463/25 |
| 5,743,800 | A | 4/1998 | Huard | |
| 5,788,574 | A | 8/1998 | Ornstein et al. | |
| 5,806,846 | A | 9/1998 | Lofink et al. | |
| 5,816,575 | A | 10/1998 | Keller | |
| 5,851,010 | A | 12/1998 | Feinberg | |
| 5,947,822 | A | 9/1999 | Weiss | |
| 5,954,335 | A | 9/1999 | Moody | |
| 5,961,384 | A | 10/1999 | Robinson | |
| 5,964,463 | A | 10/1999 | Moore, Jr. | |
| 5,993,316 | A | 11/1999 | Coyle et al. | |
| 6,019,374 | A | 2/2000 | Breeding | |
| 6,089,976 | A | 7/2000 | Schneider et al. | |
| 6,102,400 | A | 8/2000 | Scott et al. | |
| 6,120,377 | A | 9/2000 | McGinnis et al. | |
| 6,129,632 | A | 10/2000 | Luciano | |
| 6,186,895 | B1 | 2/2001 | Oliver | |
| 6,203,429 | B1 | 3/2001 | DeMar et al. | |
| 6,213,876 | B1 | 4/2001 | Moore, Jr. | |
| 6,217,447 | B1 | 4/2001 | Lofink et al. | |
| 6,227,969 | B1 | 5/2001 | Yoseloff | |
| 6,231,442 | B1 | 5/2001 | Mayeroff | |
| 6,286,834 | B1 | 9/2001 | Caputo | |
| 6,305,686 | B1 | 10/2001 | Perrie et al. | |
| 6,309,300 | B1 | 10/2001 | Glavich | |
| 6,315,660 | B1 | 11/2001 | DeMar et al. | |
| 6,322,309 | B1 | 11/2001 | Thomas et al. | |
| 6,334,814 | B1 | 1/2002 | Adams | |
| 6,336,863 | B1 | 1/2002 | Baerlocher et al. | |
| 6,341,778 | B1 | 1/2002 | Lee | |
| 6,358,147 | B1 | 3/2002 | Jaffe et al. | |
| 6,371,867 | B1 | 4/2002 | Webb | |
| 6,375,567 | B1 | 4/2002 | Acres | |
| 6,379,245 | B2 | 4/2002 | DeKeller | |
| 6,406,023 | B1 | 6/2002 | Rowe | |
| 6,409,172 | B1 | 6/2002 | Vancura | |
| 6,450,884 | B1 | 9/2002 | Seelig et al. | |
| 6,454,266 | B1 | 9/2002 | Breeding et al. | |
| 6,506,118 | B1 | 1/2003 | Baerlocher et al. | |
| 6,508,707 | B2 | 1/2003 | DeMar et al. | |
| 6,598,879 | B2 | 7/2003 | Spur et al. | |
| 6,599,192 | B1 | 7/2003 | Baerlocher et al. | |
| 6,602,136 | B1 | 8/2003 | Baerlocher et al. | |
| 6,619,662 | B2 * | 9/2003 | Miller | 273/274 |
| 6,663,488 | B1 | 12/2003 | Adams | |
| 6,679,492 | B2 | 1/2004 | Markowiak | |
| 6,679,497 | B2 | 1/2004 | Walker et al. | |
| 6,682,421 | B1 | 1/2004 | Rowe et al. | |
| 6,685,560 | B1 | 2/2004 | Hughes | |
| 6,726,564 | B2 * | 4/2004 | Hogan et al. | 463/25 |
| 6,743,102 | B1 | 6/2004 | Fiechter et al. | |
| 6,749,200 | B2 | 6/2004 | Yurkins | |
| 6,758,748 | B2 | 7/2004 | Byrne | |
| 6,786,824 | B2 | 9/2004 | Cannon | |
| 6,802,774 | B1 | 10/2004 | Carlson et al. | |
| 6,852,031 | B1 | 2/2005 | Rowe | |
| 6,855,051 | B1 | 2/2005 | Mostashari | |
| 6,877,746 | B1 | 4/2005 | Herren et al. | |
| 6,893,342 | B1 | 5/2005 | Singer et al. | |
| 6,929,264 | B2 | 8/2005 | Huard et al. | |
| 7,093,833 | B1 | 8/2006 | Horning | |
| 7,144,011 | B2 | 12/2006 | Asher | |
| 7,654,532 | B2 | 2/2010 | Feola | |
| 7,722,047 | B2 | 5/2010 | Walker et al. | |
| 7,852,223 | B2 | 12/2010 | Hecht et al. | |
| 7,922,587 | B2 | 4/2011 | Chun | |
| 2002/0002072 | A1 | 1/2002 | Sines et al. | |
| 2002/0027322 | A1 | 3/2002 | Breeding | |
| 2002/0068635 | A1 * | 6/2002 | Hill | 463/47 |
| 2003/0195043 | A1 | 10/2003 | Shinners et al. | |
| 2004/0207156 | A1 | 10/2004 | Soltys et al. | |
| 2005/0035548 | A1 | 2/2005 | Yoseloff et al. | |
| 2005/0143157 | A1 | 6/2005 | Stelzer et al. | |
| 2006/0046853 | A1 | 3/2006 | Black | |
| 2006/0181025 | A1 * | 8/2006 | Mitchell | 273/292 |
| 2006/0258442 | A1 | 11/2006 | Ryan | |
| 2007/0032283 | A1 | 2/2007 | Chun | |
| 2007/0281786 | A1 * | 12/2007 | Kuhn et al. | 463/31 |
| 2008/0076529 | A1 | 3/2008 | Richards et al. | |
| 2008/0113772 | A1 * | 5/2008 | Burrill et al. | 463/25 |
| 2008/0230993 | A1 | 9/2008 | Chun | |
| 2009/0267742 | A1 | 10/2009 | Hecht et al. | |
| 2010/0062845 | A1 | 3/2010 | Wadds et al. | |
| 2010/0093428 | A1 | 4/2010 | Mattice et al. | |
| 2010/0113118 | A1 | 5/2010 | Shigeta | |

OTHER PUBLICATIONS

International Search Report for PCT/US11039483 mailed Oct. 20, 2011, 2 pp.

Written Opinion for PCT/US11039483 mailed Oct. 20, 2011, 8 pp.

Hawley, David, "'Survival Dice' is Coward Craps", Saint Paul Pioneer Press, Jan. 28, 1995, Section: Express; You Betcha!, 2 pp.

Alm, Rick, "Casino industry gets advice on marketing", Kansas City Star, Oct. 15, 1996, Section: Johnson County/Metro, 4 pp.

Grochowski, John,, "1996 brought new casinos, new games", Chicago Sun-Times, Dec. 29, 1996, Section: Show; Casinos, 2 pp.

McCartney, Jim, "In search of Simplicity", International Gaming and Wagering Business, Aug. 1997, 4 pp.

"Games Will be Introduced at World Gaming Congress & Expo in Las Vegas", PR Newswire, Oct. 10, 1997, 2 pp.

Reid, Paul, "The Gambler & The Sea", The Palm Beach Post, Apr. 14, 1998, 5 pp.

Berns, Dave, "Pass Go, Collect Millions", Las Vegas Review-Journal, Sep. 28, 1998, 2 pp.

Rosenberg, Amy S., "At Casinos 'Easy' Games are Big Hits / Simplicity is Key, But Getting A.C. to Buy Into New Ways to Play is Not So Simple. Still, An Area Man is Trying His Hand.", The Philadelphia Inquirer, Jun. 14, 1999, 3 pp.

Grochowski, John, "Game-maker rolls out Monopoly, Yahtzee Coast-to-coast trip showcases small-town America", Chicago Sun-Times, Oct. 31, 1999, 3 pp.

Grochowski, John, "Monopoly Blackjack packs jackpot surprise", Chicago Sun-Times, May 25, 2001, 2 pp.

Grochowski, John, "A jackpot hunter's guide to Caribbean Stud", Chicago Sun-Times, Jan. 27, 2002, 2 pp.

Baron, Neil, "Games People Play", Reno Gazette-Journal, Jun. 20, 2002, 4 pp.

"New Bingo Platform from Boss Media; Boss Media, Europe's Leading Digital Gaming Software Company, Launches Online Bingo", PrimZone Media Network, Nov. 7, 2002, 2 pp.

Website: "Big Top Circus", Sigma Game, Inc., (http //www sigmagame com/bigtopcircus2 html), download date: Oct. 4, 2004, 4 pp.

Office Action for U.S. Appl. No. 10/121,251, mailed Oct. 5, 2011, 18 pp.

Office Action for U.S. Appl. No. 10/121,251, mailed Mar. 3, 2011, 16 pp.

(56) References Cited

OTHER PUBLICATIONS

Office Action for U.S. Appl. No. 10/121,251, mailed Jul. 6, 2010, 20 pp.
Office Action for U.S. Appl. No. 10/121,251, mailed Apr. 27, 2009, 13 pp.
Office Action for U.S. Appl. No. 10/121,251, mailed Aug. 14, 2008, 11 pp.
Office Action for U.S. Appl. No. 10/121,251, mailed Dec. 20, 2007, 11 pp.
Office Action for U.S. Appl. No. 10/121,251, mailed May 18, 2007, 13 pp.
Office Action for U.S. Appl. No. 10/121,251, mailed Nov. 24, 2006, 6 pp.
Office Action for U.S. Appl. No. 10/121,251, mailed Oct. 14, 2005, 15 pp.
Office Action for U.S. Appl. No. 10/121,251, mailed Apr. 26, 2005, 12 pp.
Office Action for U.S. Appl. No. 10/121,251, mailed Nov. 4, 2004, 12 pp.
Office Action for U.S. Appl. No. 10/121,251, mailed Apr. 7, 2004, 7 pp.
Office Action for U.S. Appl. No. 12/032,361, mailed Feb. 15, 2008, 8 pp.
Office Action for U.S. Appl. No. 11/422,356, mailed Aug. 17, 2007, 6 pp.
Office Action for U.S. Appl. No. 11/422,356, mailed Mar. 14, 2007, 5 pp.
Office Action for U.S. Appl. No. 11/422,353, mailed Mar. 14, 2007, 5 pp.
Office Action for U.S. Appl. No. 11/422,358, mailed Aug. 17, 2007, 5 pp.
Office Action for U.S. Appl. No. 11/422,358, mailed Mar. 14, 2007, 5 pp.
U.S. Appl. No. 10/121,251 application as filed Apr. 11, 2002, 45 pp.
Office Action for U.S. Appl. No. 12/092,548, mailed Nov. 21, 2011, 7 pp.
U.S. Appl. No. 13/042,633 entitled A Betting Terminal and System filed Mar. 8, 2011, 23 pp.
Office Action for U.S. Appl. No. 12/255,222, mailed Mar. 7. 2012, 15 pp.
Supplemental European Search Report for European Application No. 08730031 dated Jun. 29, 2012, 7 pp.
Office Action for U.S. Appl. No. 12/092,548 dated Dec. 6, 2012, 12 pp.
Australian Patent Examination Report for Australian Patent Application No. 2012202968 dated Jan. 11, 2013, 7 pp.
Australian Patent Examination Report No. 1 for Application No. 201165034 dated Sep. 17, 2013, 3 pp.
Singapore Intellectual Property Office Written Opinion for Application No. 201205094-4 dated Jul. 10, 2013, 5 pp.
Chinese Intellectual Patent Office Action and Search Report for Application No. 20080012338.1 dated Aug. 5, 2013, 11 pp.
European Search Report for Application No. 08730031.5 dated Apr. 11, 2013, 7 pp.
Singapore Intellectual Property Office Search Report for Application No. 201201042.7 dated Jul. 16, 2013, 6 pp.
Office Action for U.S. Appl. No. 12/092,548 dated Sep. 0, 2013, 13 pp.
Office Action for Chinese Patent Application No. 201180017957.1 dated May 28, 2014; 14 pps.
Office Action for U.S. Appl. No. 12/092,548, filed Aug. 21, 2008 dated Mar. 27, 2014; 16 pps.
Examiner's Report for Singapore Patent Application No. 2012010427 Dated Jun. 20, 2014; 9 pps.
Examination Report for Patent Application No. 2012202968 dated Nov. 26, 2013; 3 pps.
Notice of Acceptance for Patent Application No. 2012202968 dated Feb. 13, 2014; 2 pps.
Office Action for U.S. Appl. No. 13/513,994, filed Jun. 5, 2012 dated Mar. 24, 2014; 13 pps.
Office Action for U.S. Appl. No. 13/513,994, filed Jun. 5, 2012 dated Jul. 1, 2014; 12 pps.
Examiner's Report for Australian Patent Application No. 2013203651 dated May 2, 2014; 5 pps.
Examination Report for Singapore Application No. 2012050944 dated Mar. 18, 2014; 7 pps.

* cited by examiner

PLAYER 4

BANKER 2

(NUMBERS SHOWN ARE PAYS IN ADDITION TO RETURNED WAGER ON WIN; IN CASES WHERE TIE IS ALLOWED, TIE RETURNS FULL WAGER)

| | | TOTAL BET (EVEN MONEY) | UNRATED (8% EDGE) | | GOLD (5% EDGE) | | PLATINUM (3% EDGE) | | DIAMOND (2% EDGE) | |
|---|---|---|---|---|---|---|---|---|---|---|
| | | | PLAYER | BANKER | PLAYER | BANKER | PLAYER | BANKER | PLAYER | BANKER |
| 1 | PRESS | 2,000 | 1,500 | 1,845 | 1,615 | 2,000 | 1,695 | 2,100 | 1,730 | 2,155 |
| 2 | SWITCH & PRESS | 2,000 | 2,595 | 930 | 2,745 | 1,045 | 2,850 | 1,125 | 2,820 | 1,105 |
| 3 | SWITCH | 1,000 | 1,455 | 305 | 1,530 | 360 | 1,580 | 400 | 1,605 | 420 |
| 4 | PRESS | 1,000 | 1,150 | 460 | 1,220 | 525 | 1,265 | 570 | 1,285 | 590 |
| 5 | TWO IN A ROW | 1,000 | 2,600 | 2,260 | 2,730 | 2,425 | 2,820 | 2,535 | 2,860 | 2,590 |
| 6 | NO TIES | 1,000 | 1,055 | 955 | 1,110 | 1,030 | 1,150 | 1,080 | 1,170 | 1,105 |
| 7 | WIN BIG (2+) | 1,000 | 1,485 | 1,530 | 1,555 | 1,625 | 1,600 | 1,695 | 1,625 | 1,725 |
| 8 | WIN GIANT (4+) | 1,000 | 3,950 | 3,775 | 4,090 | 3,960 | 4,185 | 4,085 | 4,230 | 4,150 |
| 9 | QUICK 2 | 1,000 | 3,845 | 3,460 | 4,040 | 3,650 | 4,170 | 3,780 | 4,235 | 3,845 |
| ##### | LATE PAIR | 1,000 | 5,855 | 3,965 | 6,050 | 4,160 | 6,180 | 4,290 | 6,245 | 4,355 |
| ##### | TIES WIN | 1,000 | 735 | 570 | 780 | 635 | 815 | 675 | 830 | 695 |
| ##### | TAKE DOWN | 500 | 475 | -390 | 590 | -240 | 670 | -135 | 710 | -85 |
| ##### | SELL | 1,000 | 55 | -235 | 85 | -205 | 105 | -185 | 115 | -175 |

FIG. 9

RE-CHARACTERIZATION OF BETS AT TABLE GAMES

RELATED APPLICATIONS

The present application is a continuation-in-part of PCT patent application No. PCT/U.S. Pat. No. 0,854,146 (the "'146 Application" hereinafter), filed Feb. 15, 2008, the entirety of which is hereby incorporated by reference.

The present application is a continuation-in-part of U.S. patent application Ser. No. 12/092,548 (the "'548 Application" hereinafter), filed May 2, 2008, entitled Re-Characterization of Bets at Table Games;

The '146 application and the '548 application both claim the benefit of and priority to the following provisional patent applications:

U.S. Provisional Patent Application Ser. No. 61/024,827, filed Jan. 30, 2008, entitled Recharacterization of Bets at Table Games;

U.S. Provisional Patent Application Ser. No. 61/023,290, filed Jan. 24, 2008, entitled Recharacterization of Bets at Table Games;

U.S. Provisional Patent Application Ser. No. 61/020,470, filed Jan. 11, 2008, entitled Method and Apparatus for Playing Baccarat with Late Play Options;

U.S. Provisional Patent Application Ser. No. 61/012,230, filed Dec. 7, 2007, entitled Table Game Session Play U.S. Provisional Patent Application Ser. No. 60/943,171, filed Jun. 11, 2007, entitled Blackjack Session Play;

U.S. Provisional Patent Application Ser. No. 60/890,328, filed Feb. 16, 2007, entitled Systems and Method for Conducting Casino Games;

U.S. Provisional Patent Application Ser. No. 61/028,558, filed Feb. 14, 2008, entitled Proposition Bets for Baccarat and Other Games;

Each of these applications is hereby incorporated by reference in its entirety.

The '548 application also claims the benefit of and priority to the following:

U.S. Provisional Patent Application Ser. No. 60/917,196, filed May 10, 2007, entitled Systems, Methods and Apparatus for Additional Game Options in Blackjack, Baccarat and Other Games;

U.S. Provisional Patent Application Ser. No. 60/939,263, filed May 21, 2007, entitled Systems, Methods and Apparatus for Additional Game Options in Blackjack, Baccarat and Other Games;

Each of these applications is hereby incorporated by reference in its entirety.

The present application also claims the benefit of and priority to the following provisional patent applications:

U.S. Provisional Patent Application Ser. No. 60/990,165, filed Nov. 26, 2007;

U.S. Provisional Patent Application Ser. No. 61/014,299, filed Dec. 17, 2007;

U.S. Provisional Patent Application No. 61/031,125, filed Feb. 25, 2008;

U.S. Provisional Patent Application No. 61/044,249, filed Apr. 11, 2008;

Each of these applications is hereby incorporated by reference in its entirety.

The present application is also related to the following patent applications:

PCT patent application Serial No. PCT/U.S. Pat. No. 0,779,518, filed Sep. 26, 2007; and U.S. patent application Ser. No. 11/735,231, filed Apr. 13, 2007, entitled Incremental Revelation of Results in a Game of Chance.

Each of these applications is hereby incorporated by reference in its entirety.

FIELD OF THE INVENTION

The present invention is directed to increasing betting options in table games.

BRIEF DESCRIPTION OF THE DRAWINGS

FIG. 9 illustrates an exemplary page from a look up table.

DETAILED DESCRIPTION OF THE INVENTION

Figure 1:
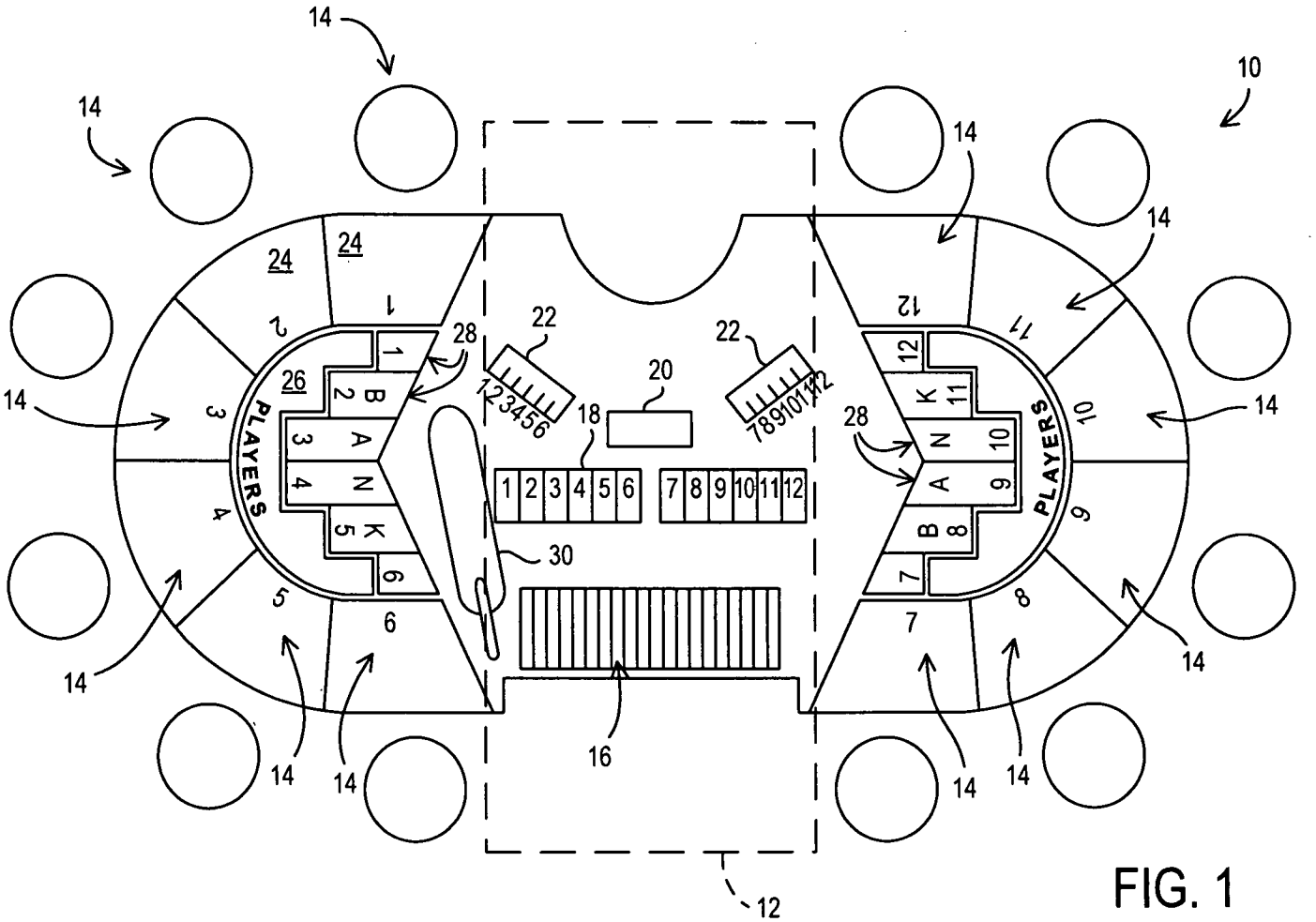
FIG. 1 PRIOR ART
FIG. 1 illustrates a top plan view of a traditional baccarat table.

Games like baccarat and blackjack are generally considered low volatility, static games. Because the volatility is so low, players may play for hours and not incur substantial gambling losses relative to the size of the player's average wager. Conversely, gaming establishments that provide such games enjoy a relatively low house advantage, which may vary from 0.5% to 2.5% depending on the precise rule set in place for the game and/or player strategy. While Blackjack allows players to make some decisions during game play, these decisions are strictly limited. Baccarat goes even further and allows no decision after the player has decided whether to bet on the banker hand or the player hand. While the limitations on decision making helps preserve the low volatility, there may be times where a player may wish that a rule variant existed so that the player could feel more involved in the game. Gaming establishments may likewise desire to provide these opportunities, albeit at a higher margin.

Embodiments of the present disclosure allow for such opportunities through the use of a concept termed herein "bet re-characterization" as well as other bets such as "late" bets and "side" bets. A bet re-characterization is a bet that occurs when, after a player places an initial bet within a game, the player is afforded the opportunity to change the criterion by which the initial bet is determined to be a winning bet or a losing bet. In exchange for the right to make this change, the house may increase the house advantage for the re-characterized bet. A late bet is also a bet that takes place after at least one initial card has been dealt, but prior to the final resolution of a given hand or round of play.

An example using baccarat is illustrative. In baccarat, a bettor places an initial wager on either the player hand or the banker hand, depending on which hand the bettor thinks will win. The bettor, for this example, bets on the player station. The dealer deals two cards (e.g., two-jack) to the player station and two cards (e.g., four-ace) to the banker position to form an intermediate result (e.g., the player has a 2 and the banker has a 5) short of a final resolution of the game instance. That is, the rules of the game dictate that, in this circumstance additional cards are to be drawn by one or both hands. Based on the cards currently shown, the bettor decides to re-characterize her bet such that the bet is no longer a bet on the player station winning. In particular, daunted by the odds of beating a dealer five, the player re-characterizes her bet so that the changed bet is that the player station hand will include a pair (either two jacks or two twos) upon final resolution of the game instance. The bettor places a re-characterization token on the stack of chips representing her wager (e.g., the token might be labeled "Pair"). By re-characterizing the wager, the bettor replaces the original wager with the re-characterized wager. The game is then resolved upon the player station receiving a hit card (e.g., a four, for a total of 6). Under this fact pattern, the banker also takes a hit (e.g., a nine, for a total of 4). Normally, bettors betting on the player station would win because the player score (6) beats the banker score (4). However, because the bettor had re-characterized her bet into a pair bet, the bettor loses. Assume instead that the player drew a 2, for a total of 4. The banker stands on his five since the player draw card was a two. Normally, the bettor would lose a bet on the player station, but because the bettor had re-characterized her bet to have a pair, the bettor would win.

While the pair bet is but one form of bet re-characterization, there are numerous other events, stages, and/or states within the game by which the player may be offered and/or elect to re-characterize her bet. Note also that in this example, the re-characterized bet supersedes the original bet. There are other forms of bet re-characterization discussed in greater detail below such as where the re-characterization bet subsumes the original bet, or splits into a partial original bet and a new bet. As yet another alternative, instead of a re-characterized bet, the new bet may be offered as a side bet or second bet. In any of these situations, the odds may be adjusted to give the house a more favorable house advantage, a less favorable house advantage, or maintain the normal house advantage as desired.

Various systems may be deployed to provide bet re-characterization and several examples are provided below. The present disclosure will focus on baccarat as an example, but it should be appreciated that bet re-characterization may be applied to other table games such as blackjack, roulette, craps, Sic Bo, Pai Gow (tile and poker variations), LET IT RID™, CARIBBEAN STUD™, 3-CARD POKER, 4-CARD POKER, SPANISH 21, variants of such games (e.g., Chemin de Fer), or the like.

Simple Table

The rules of baccarat are well understood, but the interested reader is directed to www.wizardofodds.com/baccarat for a more detailed explanation. Turning now to FIG. 1, an embodiment that is relatively simple to implement is presented. FIG. 1 illustrates a traditional baccarat table 10 with a dealer station 12 and a plurality of player stations 14. The dealer station 12 is sized to accommodate two dealers, one on either side. Many "high roller" style baccarat tables actually have three dealers present, and the dealer station 12 may provide room for the number of dealers assigned to the table. The dealer station 12 is shown to include a chip rack 16, as well as commission indicia 18, bank hand area 20, and tie bet indicia 22. The chip rack 16 is sized to accommodate chips and plaques as is well understood. The commission indicia 18 allow the house to keep a record of any commissions that the player may owe for betting on the banker hand. Players usually settle the commission at the end of the shoe and/or before leaving the table so as to minimize disruption of game play. As illustrated, commission indicia 18 are divided into boxes for each player station. The banker hand area 20 is the place to which the cards forming the banker hand are dealt. The tie bet indicia 22 are the locations on the table where a player may indicate a wager on a tie between the banker hand and the player hand. Again, the tie bet indicia 22 are divided so that there is a box for each player station. While the tie bet indicia 22 may conceptually be thought of as part of the player stations 14, the positioning of the tie bet indicia 22 in the center of the table makes it impractical for a player to position a wager therein, so in most instances, the dealer will position such a wager, and thus, for the purposes of the present disclosure, the tie bet indicia 22 are included within the dealer station 12. While not illustrated in FIG. 1, some baccarat tables have display panels that indicate recent historical outcomes. Players sometimes use such historical outcomes in an effort to predict trends within a series of game instances.

Each player station 14 includes a chip area 24 where the player may position her chips. A player bet area 26 exists in front of each chip area 24. As illustrated, the player bet area 26 is not specifically delimited for each player station, but such indicia are sometimes present. Additionally, each player station 14 includes a bank bet area 28 with appropriate indicia to link wagers placed therein to a particular player station 14. The dealers may use a shoe (not shown) to hold cards and a paddle or wand 30 to move cards and/or chips to particular locations on the table 10 as is well understood.

Figure 2:
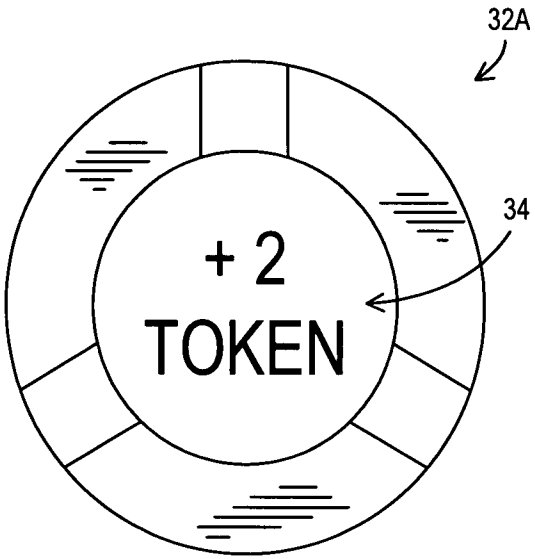

At least some embodiments of the present disclosure may operate on such a simple table 10. These embodiments use a bet re-characterization token to indicate that a bet has been re-characterized by a player. Exemplary re-characterization tokens 32A-32D (generically re-characterization tokens 32) are illustrated in FIGS. 2-5. FIG. 2 illustrates a very simple embodiment of the re-characterization token 32A with bet re-characterization indicia 34 thereon. The bet re-characterization indicia 34 includes enough information to inform the viewer what re-characterization bet is denoted by the token 32A. In the illustrated embodiment, the re-characterization is a "+2" re-characterization. More information on the various re-characterizations possible is set forth below.

Figure 3:
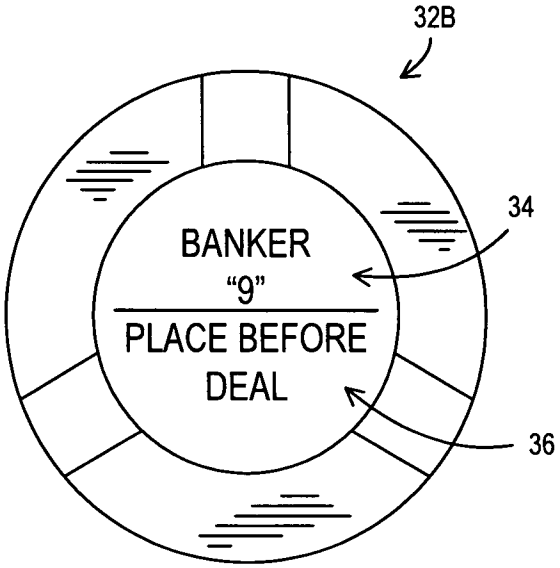
FIGS. 2-5 illustrate various re-characterization tokens and indicia used thereon to denote various types of re-characterization activity.

The re-characterization token 32B of FIG. 3 includes the re-characterization indicia 34, which, in this embodiment are indicia indicating that the token is a "banker nine" re-characterization token, as well as rule indicia 36 which may set forth rules that are applied to use of the token. For example, as illustrated, the rule is that the token 32B must be placed before the deal. Other rules may be imposed on use of the tokens 32 as will be further explained below.

Figure 5:
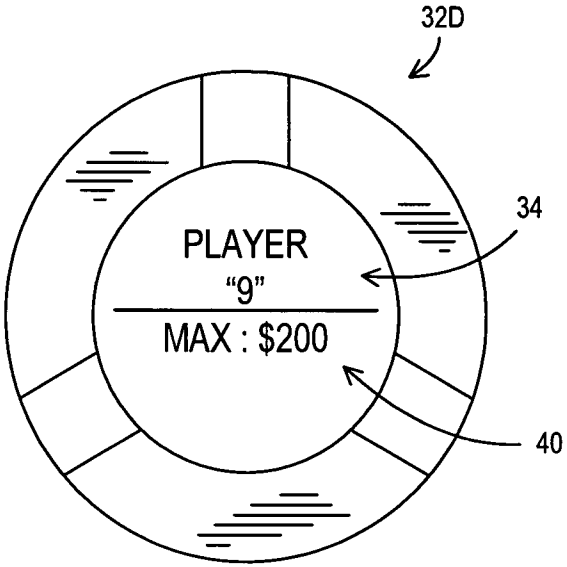
Figure 4:
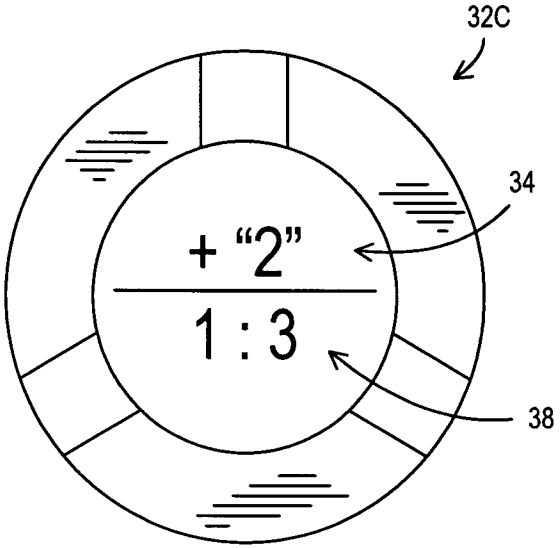

Instead of a rule on use of the token, a rule on payouts may be provided on the tokens 32. Token 32C (FIG. 4) has odds indicia 38 disposed thereon. Likewise FIG. 5 illustrates token 32D which has max bet indicia 40 disposed thereon.

While illustrated as something that looks like a chip or coin, it should be understood, that as used herein, the term "token" is defined to be a physical element capable of indicating a bet re-characterization (e.g., a physical chip bearing indicia corresponding to a particular bet re-characterization). Specifically included within the definition of token are chips, coins, markers, lammers, buttons, cards (perhaps uniquely marked), dice, tickets, or other paper substrate, a ring, a bowl, a chip tray or sleeve, a chip clip, and charms. The indicia may be textual, graphical, color-coded, or the like. For example, a blue button may denote a first type of bet re-characterization and a red button a second type of bet re-characterization. Color codes could be published and understood by the public in much the same manner that chip color codes denote value and are understood by the public (e.g., green=twenty-five dollars). More esoteric tokens are described in greater detail in the alternate embodiment section below.

Figure 6:
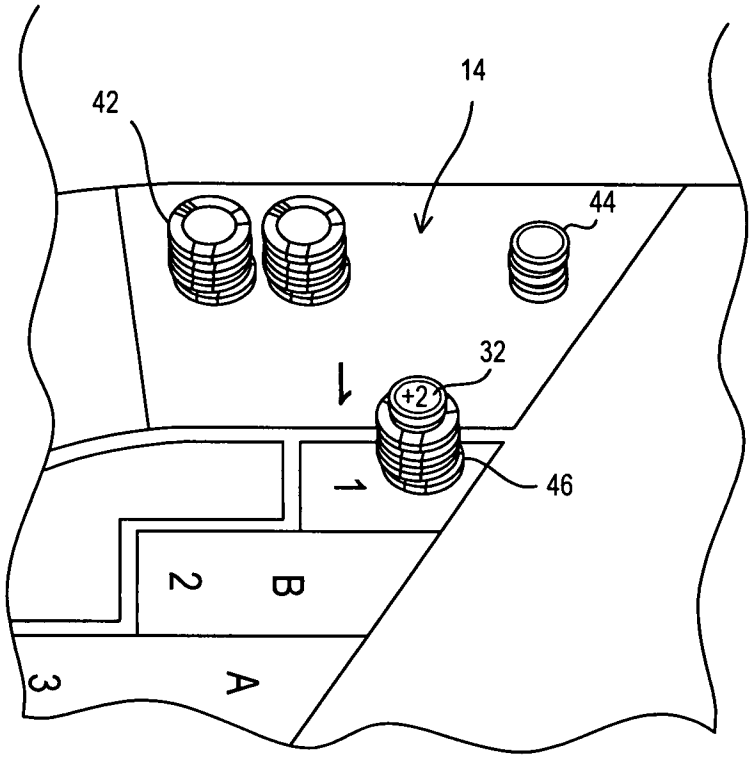
FIG. 6 illustrates a bet re-characterization token in use on a wager.

Returning to the table 10 in FIG. 6, use of a token 32 is illustrated. In particular, a player at player station one has a stack of reserve chips 42 from which the player makes wagers. The player also has a stack 44 of tokens 32 from which the player may select an individual token 32 to re-characterize a bet. The player has placed a wager stack 46 on the banker hand and has denoted that this wager is a re-characterized wager by placing a token 32 on top of the wager stack 46. While illustrated as being on top of the wager stack 46, the token 32 may be placed underneath, beside, in the middle of, or otherwise be associated with the wager stack 46 to denote the re-characterization of the wager stack 46.

The cards are dealt as normal, and re-characterized bets at a first player station do not affect normal wagers at other player stations. Thus, in this simple embodiment, no changes are specifically required to the table, so a player may approach the table, see a table layout with which she is familiar, and begin play without the game appearing to be a new game.

Figure 7:
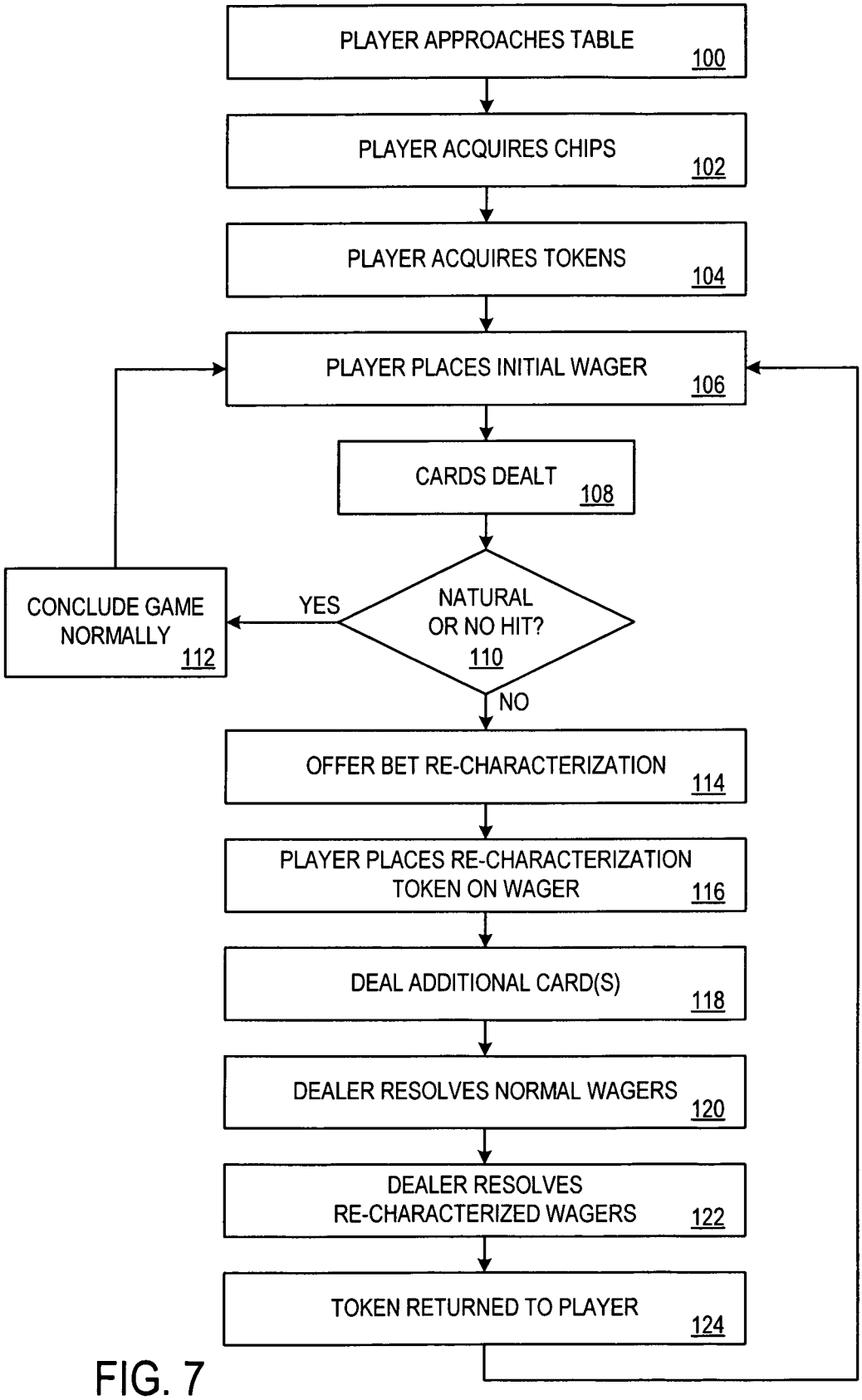
FIG. 7 illustrates a flow chart showing an exemplary method of use of a bet re-characterization token.

Against this backdrop of physical elements, a brief description of the flow of the game is provided with reference to FIG. 7. The gaming establishment may conduct game play as follows. The player initially approaches the table 10 (block 100). The player acquires chips from the dealer as is normal (block 102). Note that in some instances, the player may acquire chips before approaching the dealer. The player likewise acquires bet re-characterization tokens 32 from the dealer (block 104). Various other ways of acquiring re-characterization tokens 32 are described in greater detail below. When the dealer signals that new bets are being accepted, the player places an initial wager (block 106). The player does this by placing one or more chips (e.g., wager stack 46) in the player bet area 26 or the bank bet area 28 as is well understood. Two cards are dealt to the player station with the highest player hand wager and two cards are dealt to the banker hand area 20 (block 108). The cards are turned over so that everyone sees the cards. Turning the cards over is sometimes referred to as "squeezing" the cards. A determination is made whether either hand is a "natural" (i.e., an eight or nine) or whether both hands are pat hands (i.e., the player hits on a hand of five or less and, if the player stands, the banker hits on a five or less, so dealt hands of six-six, seven-seven, six-seven, or seven-six are pat hands (note that a dealer may take a card on a banker score of six if the player is dealt a six or seven as the player's third card—again, the interested reader is directed to the baccarat rules at www.wizardofodds.com for a complete explanation of the stand/hit rules)) (block 110). If the answer to block 110 is yes, someone has a natural or there will be no hit card, then the game instance is concluded normally (block 112) according to well understood rules.

If, however, the answer to block 110 is no, someone will take a hit, then the dealer (or other person) may indicate that the table is open to accepting bet re-characterizations at this time (block 114). If a player desires to re-characterize her bet, the player places a re-characterization token 32 on the wager stack 46 (block 116) as illustrated in FIG. 6. The dealer then deals additional card(s) to the appropriate hand(s) as indicated by the well understood rules of baccarat (block 118). The dealer resolves normal wagers (i.e., those that have not been re-characterized) using the normal payout rules for baccarat (block 120), marking any commissions within the commission indicia 18. The dealer then resolves any wagers that have been re-characterized (block 122). Special procedures may be provided for payouts associated with re-characterized wagers as described in greater detail below. Likewise, the odds for the re-characterized wagers may be different than 1:1 or 0.95:1 as is common in baccarat, and thus the amount of the payout may need to be calculated. Again, more information on this procedure is provided below. The re-characterization token 32 may be returned to the player (block 124), and play repeats as indicated. Note that the dealer may resolve normal and re-characterized wagers in the opposite order, or may resolve them concurrently as desired. The precise order of resolution is not central to the present disclosure. Likewise, the flow chart of FIG. 7 does not specifically address how commissions are handled, but any technique for handling commissions is contemplated.

An alternate embodiment also within the scope of the present disclosure is to vary when bet re-characterizations may be allowed to take place. Instead of offering bet re-characterization after the first four cards are dealt and revealed, the result of the initial deal could be revealed incrementally and bet re-characterization may be offered after each individual card is revealed. As yet another alternative, the bet re-characterization may take place before the first card is dealt (e.g., before play begins, a player places a token that provides an option, whether exercised by the player or activated conditionally by a set of rules, to re-characterize a bet during an intermediate stage of the game). Some games, such as baccarat and blackjack, have "natural" granularity in this regard, as it is common for cards to be dealt one at a time (thus presenting many opportunities or stages for re-characterization). Other games, such as roulette, do not normally feature such staged outcome revelation, though they may be designed to do so. For more information about parsing an outcome into incremental intermediate revelation events, the interested reader is directed to previously incorporated U.S. patent application Ser. No. 11/735,231.

Acquiring Re-Characterization Tokens

In a first embodiment, bet re-characterization tokens 32 are free and have no monetary value. Players may be issued such tokens 32 at a table from the dealer as needed and may be required to return the tokens 32 before leaving the table. The tokens 32 may have further indicia (not shown) which associates or assigns particular tokens 32 to particular player stations 14 to facilitate tracking the tokens 32 (e.g., a token 32 may state "Player station 1" to indicate that it belongs to that player station or may state "Table TK342" to indicate that it belongs to a particular gaming table). In one embodiment, a player may receive tokens as a set (e.g., a bundle, package, or group that includes one each of five different types of re-characterization tokens). In another embodiment, a player may request a specific, individual token. In other embodiments, players may not handle tokens (either dealers may handle the tokens at the request of players as described below, or physical tokens may not be utilized, such as when the game is conducted at an electronic or virtual table). In one such embodiment, a player may request a re-characterization (e.g., orally or through use of an electronic and/or electromechanical player interface, the player requests a "Switch"), and the dealer may then subsequently top the player's bet with an appropriately-labeled token, signifying the requested re-characterization (e.g., the dealer picks up a "Switch" token from her tray and places it on top of the player's original bet). Alternatively, tokens 32 may be received from a kiosk, vending machine, a cashier's cage, player's club, or other location/device as desired.

As yet another alternative, the tokens 32 may be purchased before or while a player sits at a table 10. In such an embodiment, the tokens 32 may have a cash value for which the token 32 may be redeemed (or they may not—tokens are purchased, and then must be used or forfeited). Tokens 32 that represent different types of bet re-characterizations may cost different amounts. Likewise, tokens 32 that have different rules may cost different amounts. Various rules might be odds (e.g., a first "pair" bet token 32 may pay 1:1 and cost five dollars. Another may pay 2:1 and cost twenty dollars), size of wager (tokens 32 covering bets under five hundred dollars cost $10 and those covering bets over five hundred dollars cost $50), or the like. If the token 32 is sold to the player during game play, the cost of the token 32 may reflect the conditions of the active game instance and may require that the token 32 be played in that game instance (e.g., a win by 2 re-characterization token costs $20 when player is ahead, but is free when player is behind). As still another option, the token may cost a fixed percentage of the player's initial wager. For example, a "pair" token could pay 4:1, but cost 20% of the player's initial wager. Such a cost basis may simplify the math in some instances. For the sake of simplicity, many of the examples used herein are even amounts. It is to be understood that a precise calculation of values may result in an uneven amount.

In yet another embodiment, the tokens 32 may be provided as a comp, as a promotion, or as part of a retail package (including gaming and perhaps other casino services or amenities). It is possible that free tokens may have fees, rules, restrictions, or the like which offset any player advantage (e.g., tokens are given out for free, but may only be used in certain game circumstances, such that a theoretical house advantage is preserved).

In still another embodiment, a player may receive the tokens as part of a payout from another game. For example, a slot machine may dispense tokens 32 as part of a cash out procedure, or may print a receipt for tokens 32 as part of a cash out procedure, said receipt then exchanged for tokens at a second location. In such instances, the payout may be reduced by the value of the tokens 32 provided, or the tokens 32 may be provided as a bonus to the player.

The player may also pay for the re-characterization token with a portion of the initial wager. For example, the player initially wagers five hundred dollars on the player hand, and then re-characterizes the wager as a "pair" wager. The player may pay twenty-five dollars from the initial wager so that the remaining four hundred seventy-five dollar wager is re-characterized.

For tokens 32 that have been purchased, the token may indicate the purchase value and/or the resale value. The resale value may be more, less or even money relative to what was paid depending on the terms of the sale.

In still another embodiment, the player may never actually handle the bet re-characterization token 32. Rather, the player may indicate, audibly or through a designated body motion or gesture, that the player desires to re-characterize her bet. The dealer may then select an appropriate bet re-characterization token 32 and place the token 32 on the player's wager stack 46. The dealer may, in the event of a "switch" (or other) bet move the stack to a new location.

There may also be restrictions on use of the token 32. One restriction may be who may use a token 32. For example, such tokens 32 may be available only to high rollers or members of the casino loyalty program. Or they may be free to high rollers, but other players may purchase the tokens 32 for a fee. Still another potential restriction might be placed on when a token 32 may be purchased. For example, tokens 32 may only be purchased between 10 AM and 4 PM. Alternatively, tokens 32 may be purchased at any time, but only used during specific times. Such time restrictions may be enforced such that game play during high-volume periods is not slowed. Another possible restriction is how frequently such bet re-characterizations may be used. For example, bet re-characterization may be restricted to once every X wagers or a certain number of uses per time unit.

Tokens 32 may be color coded in a manner that does not designate a particular bet, but has meaning within the context of a game instance. For example, the tokens may be colored brown, blue, and purple. After the first cards have been dealt, the dealer announces a set of appropriate re-characterization options, each of which is tied to one of the three token colors. Thus, for a given game instance, the brown is the win by two, the blue is switch, and the purple is banker 9. In another game instance, the brown is long shot, the blue is press, and the purple is push to next hand. In another game instance, blue tokens are placed during a first stage, whereas red tokens are placed during a second stage. Other arrangements are possible.

Still other mechanisms and locations for providing tokens and/or restricting their availability and/or use are possible.

Types of Re-Characterization Bets

There are many different ways bets may be re-characterized. As used herein, "re-characterize" and "re-characterization" are generic terms that encompass the various ways in which initial bets may be changed into new or altered bets. Within the definition of re-characterization, there may be considered to be three distinct embodiments.

The first embodiment is a re-characterization bet that supersedes the initial wager. If a re-characterization bet supersedes the initial wager, then the entirety of the initial wager becomes the new wager. There is no portion of the initial wager left. Likewise, the new wager is for the same amount of value as the initial wager.

The second embodiment is a re-characterization bet that subsumes the initial wager. If a re-characterization bet subsumes the initial wager, then the entirety of the initial wager becomes part of the new wager. There is no portion of the initial wager left. However, additional value is added to the initial wager such that the new wager is for an amount greater than the initial wager. Note that the additional value can come in the form of additional chips (e.g., a player increases her wager from $100 to $200) or from adding a bet re-characterization token 32 that has value (e.g., a player paid $10 for a token 32 and adds it to the initial $100 wager resulting in an effective wager of $110).

The third embodiment is a re-characterization bet that splits the initial wager into a re-characterized portion and a diminished remaining portion. For example, the player may make an initial wager of five hundred dollars on the banker position, and then re-characterize the initial wager by splitting the initial wager into a two hundred dollar wager on a pair and a three hundred dollar diminished initial wager on the banker position. The ratio of the split may be dictated by the re-characterization or by the player as desired. For example, some re-characterization bets may require a fifty-fifty split between the re-characterized portion and the diminished initial portion, others may require a seventy-thirty split or some other ratio, and still others may leave it to the player to decide how to split the initial wager. Note that for split bets, in some embodiments, two tokens may be used. The first token is put on the re-characterized portion as previously described, and the second token is put on the diminished initial portion and may state that the diminished initial portion is paid out at normal odds (e.g., the token indicates "even money" or "normal odds"). The two tokens may help reduce confusion by players that think both wagers are paid at the new odds and by dealers who may need to pay each stack of chips at different odds.

In contrast to a re-characterized bet, some of the bets described herein may also be implemented as side bets, second or "late" bets, or proposition bets. While there is a substantial body of literature on such bets, the concepts are distinct. Side bets differ from the concept of a re-characterized bet in that side bets keep the initial wager intact and add the side bet. For example, in THREE-CARD POKER, there is the ante bet (the initial wager) and the pair-plus wager (the side wager). Each wager is distinct and does not affect the other. Late bets may be thought of as side bets that occur after an initial wager has been placed (e.g., during an intermediate stage of a game); however, these are additional bets, and do not re-characterize the initial wager. Likewise, some of the bets described herein may be implemented as a proposition bet (commonly, a bet with somewhat long odds that may be placed without an accompanying base game wager). Again, the concepts are distinct. A proposition bet does not rely on any pre-existing initial wager that is re-characterized. Rather, the proposition bet is a standalone bet on a particular event such as a hard way eight in craps. It should be noted that while most of the discussion below focuses on re-characterized bets, the present disclosure is not limited to re-characterized bets, and the techniques described herein may readily be extended to such proposition, side, and/or late bets.

Figure 8:
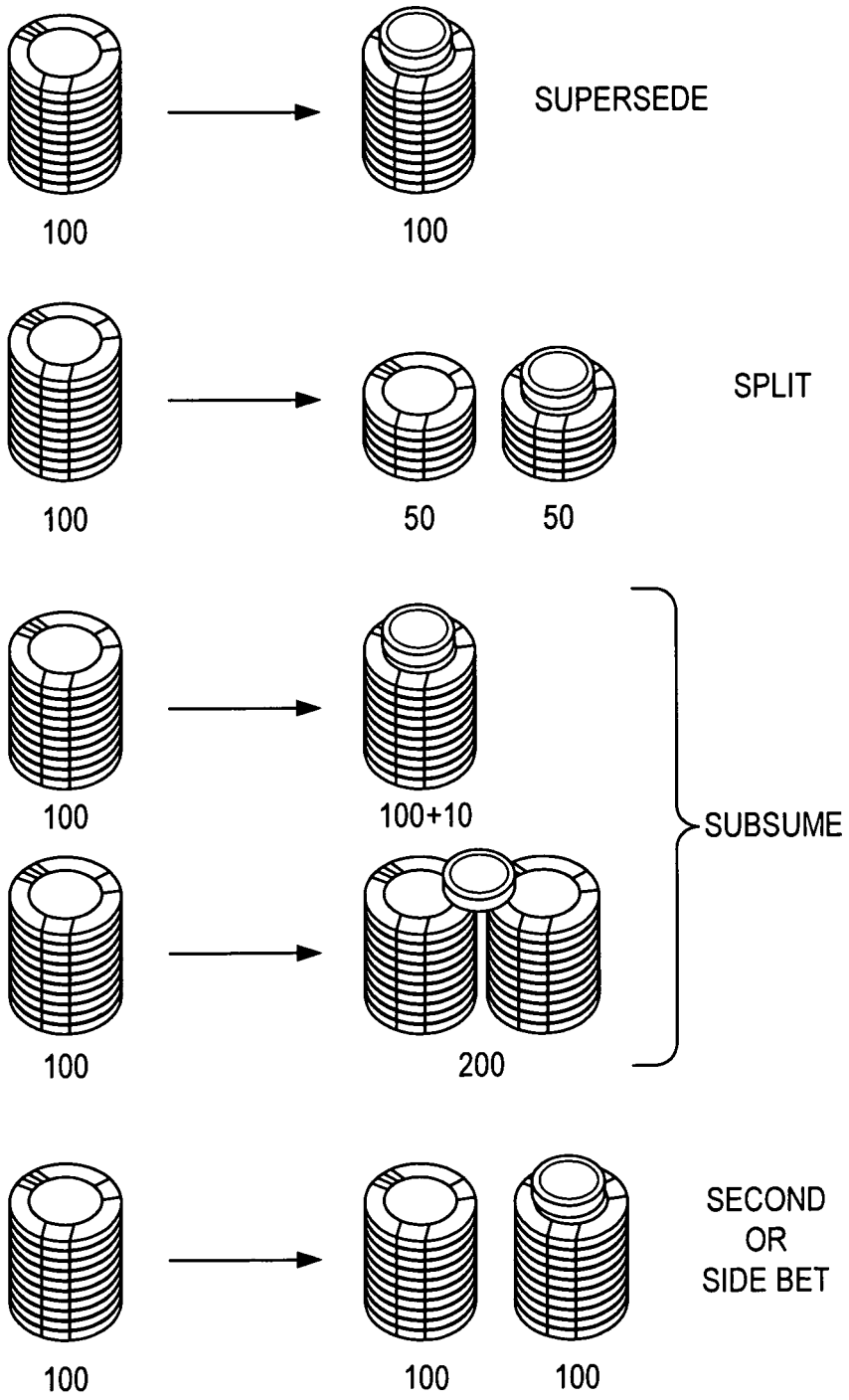
FIG. 8 illustrates various embodiments of re-characterization compared to a second bet.

A summary of the various definitional distinctions is presented in FIG. 8. What follows is a list of various particularly contemplated types of bet re-characterizations and other wagers suitable for use on the tables of the present disclosure. Note that many of the different types may be implemented as supersede re-characterizations, subsume re-characterizations, or split re-characterizations.

"Hedge"—Player places a hedge bet on the position not initially selected, sort of like an insurance bet. Ex: a player places an initial wager on the banker position, but the deal is player 9-4, banker Q-7. The player may place a hedge bet on the player side. The hit card is a 5, resulting in a player hand win of 8:7. The original wager loses, but the hedge bet on the player hand wins.

"Win by X"—Ex: A player places a "Win by Two" token, his original bet must now win by a margin of at least two. If it does, he may be paid at a higher rate. Any margin amount may be substituted for X. Outcomes of a tie or push may result in a loss of the player's bet. In one example embodiment, a player re-characterize to bet "Win Big," meaning his bet pays an adjusted amount if the player wins by a margin of 2, 3 or 4 (all other wins are losers). In another example embodiment, a player may bet "Win Giant," meaning his bet pays an adjusted amount if the player wins by a margin of 4, 5, 6, 7, 8 or 9 (all other wins are losers).

"Roll Over"/"Next Hand"/"Pass"—Ex: When a player places a "Roll Over" token, his original bet is "pushed forward" or moved to a subsequent hand. In one example, the player may also be required to post an additional minimum bet on the subsequent hand to do this. In other words, the player might "rescue" a disadvantaged original bet from Hand #1 and push it forward to Hand #2, but he must also agree to post a separate minimum bet on Hand #2. The player may be given a choice as to whether the bet for Hand #2 is on the player hand or the banker hand. If the original bet from Hand #1 wins on Hand #2, it pays at lesser odds (e.g., dynamically calculated based on the first four cards dealt in Hand #1). In one embodiment, the bet for the second hand must be at least equal in amount to the bet for the first hand. In other embodiments, an additional minimum bet on Hand #2 may not be required; instead, by playing a "Next Hand" token, a bet form Hand #1 is simply pushed forward to Hand #2 where it pays at lesser, adjusted odds if it wins. As yet another option, the players could demur on a first hand in exchange for premium odds or other benefits payable in a second (or subsequent or multiple subsequent) hand. For example, a player could accept a "next hand" wager on a favorable six and pay no commissions on the next two hands.

"Two (or more) in a Row"—Ex: A bettor wagers $100 on "banker". After the initial deal, it becomes clear that the banker side is ahead, 8-2. The bettor then places a "Two in a Row" token. The bettor must now win this hand as well as the subsequent hand. If he does, he is paid at better odds (e.g., the calculation considers the odds of winning the first hand given the first four cards, as well as the odds of winning the second hand, and a house edge). In one embodiment, the bet for the second hand must be at least equal in amount to the bet for the first hand, though a new bet for the second hand may not be required. In a variation of this, a player could bet that he will lose two or more hands in a row. In another variation, the player can bet that he will win at least a predetermined amount of hands over the course of two or more hands.

"9 Insurance"—Ex: A bettor places a bet on "banker" in baccarat. After the first four cards are dealt, the banker is ahead, 7 to 5. The player places a "9 Insurance" token. If the bettor wins, his original bet is paid at a lesser rate (e.g., dynamically calculated based on the first four cards dealt). If the bettor loses to a "9" (the "player" position draws a "4"), his bet pushes. Thus, the insurance protects players from losing to a "9". In variations, bettors might be protected from opposing outcomes other than "9". For example, insurance might protect against any loss by a margin of 1 (a "bad beat"). In another example, insurance might protect any loss. In one embodiment, a player insures his bet by paying a dynamically-priced premium (based on the cards in play and the player's original bet).

"Add 2"/"Extra Points"—A player of a baccarat game can indicate that he or she would like to "purchase" extra points at any time towards the hand he or she has wagered upon. For example, after the first four cards have been dealt, two to the Player Hand and two to the Banker Hand, the Player has "4" and the Banker has "6". Bettor A wagering on the Player Hand may then indicate (e.g., by use of a token) that he or she wants two points added to the Player Hand total. The hand is then resolved, however when bets are settled, Bettor A's wager is settled based on the final total of the Player hand+2 and the final total of the Banker hand. In some embodiments, a player may have the option to "deduct" or subtract points from one of the hands on the table. If the bettor is putting himself in a worse position, he or she may be given a benefit (e.g., a bonus, a higher payout, advantageous rule change, etc.). In some embodiments, points can always be added to a hand unless they give the player a Natural. A player with a "7" cannot use a +2 chip because it results in a natural. In some embodiments, points are not added if the hand results in a natural without the added points (e.g., the Player hand results in a "9", even for a bettor that has used a +2, the hand total is still 9 (the +2 is ignored on specified predetermined totals)). In some embodiments, points are always added regardless of the outcome (e.g., the Player hand results in a "9", but a bettor that has used a +2 now has a "1"). In some embodiments, regardless of what the next/hit card is, the points are added to the hand. In some embodiments, the traditional hit rules apply to those who have used the "extra point" option. For example, normally, the Player Hand hits on anything less than a five and stands on 6 or above. If the Player Hand has a "4" and chooses to add 2, resulting in a "6", then the hit does not apply (e.g., the Player Hand becomes pat for that specific player). The same rules may be used if the player has wagered on Banker. For example, the Player Hand totals "4" and the Banker Hand totals "4". Bettor A uses a +2 option for the Banker hand resulting in a "6" and the Player Hand then draws a "4". The Dealer deals another card for the Banker, but it does not apply when settling Bettor A's wager according to the hit rules in baccarat.

"Press"/"Raise"—Ex: By using a "Press" token, a bettor can increase his bet mid-way through a hand. For example, after the first four cards of a baccarat hand are dealt, the bettor can place a token and increase (e.g., double) his bet. Both his original bet and the late bet may be paid at an adjusted rate (e.g., dynamically calculated based on the first four cards dealt) thus resulting in a re-characterization of the initial wager. In other embodiments, only the added amount may pay at an adjusted rate. In one embodiment, the total payoff for both the original wager and late bet may be paid at an adjusted rate, though by subtracting some payout for the late bet amount, the player may be given the illusion that the original wager is paid at even money (e.g., the player bets $10, and then uses a "Raise" option to add $100; the adjusted payout considers the entire $110 bet and pays $87.50; when paying this amount, the dealer pays the original bet an even $10, and pays the late bet $77.50). In one embodiment, there may be a limit to the amount of money which a player may bet through such a re-characterization, though this may not be necessary if a high enough house edge is used (the house's appetite for risk exposure increases with the house edge, as the house is happy to book even extremely large bets at a high house edge). In some embodiments, this maximum bet amount may be dynamically determined (e.g., based on factors such as the player's profile, the house's financial predicament in a given month, etc).

"Switch"—Ex: After betting on "banker," a bettor decides mid-way through a baccarat hand he would rather bet on "player". The bettor places a "Switch" token and the player's bet switches sides. The bet is paid at an adjusted rate (e.g., dynamically calculated based on the first four cards dealt).

"Split (to Tie)"—Ex: After betting $100 on "player," a baccarat bettor decides he'd like to take some of his original bet and place it on another outcome. For example, the bettor takes $25 from the base bet, and adds a "Split to Tie" token on top. Thus, his original bet has now been split between two outcomes—the $75 base bet pays 1:1 if "player" wins, and the $25 bet pays at an adjusted rate should a tie occur (e.g., dynamically calculated based on the first four cards dealt).

As described, this is an example of a split re-characterization. A player can "split" to various outcomes other than "Tie" in this manner. Further, in some embodiments, when players want to re-characterize only a portion of their initial wager, they may use a "Split," "Divide" or "Half" token. A "Half" token might indicate that a given re-characterization applies only to half of an original wager. Half tokens may be used in combination with other tokens (e.g., a player placing "Half" and "Win by Two" tokens means he is re-characterizing half of his base bet to an outcome of "Win by Two"). Half tokens may be "smart" or incorporate RFID technology. In some embodiments, the re-characterized portion and the portion remaining on the original bet may have different associated house edge values (e.g., the original bet stays at 1.2% while the re-characterized portion pays an adjusted amount based on the re-characterization, the cards in play, and a larger house edge value). In other embodiments, re-characterizing a portion of an original wager may also affect the house edge of the non-re-characterized portion. Note that "splitting" or dividing a wager amount is separate from a re-characterization that splits a single two-card hand into two separate one-card hands (described below).

"Multi-Split"—A player can divide his original wager into multiple portions, each betting on a different outcome. For example, a player might divide his bet into three portions, one portion representing 50% of the original wager, and two 25% portions. The 50% portion may remain on the original wager (e.g., Player or Banker in baccarat), and pay at predetermined odds. One 25% portion may be re-characterized to "Big Win" and the other 25% portion may be re-characterized to "Giant Win," each paying at different adjusted rates. Of course, players may subdivide their original bet into any number of re-characterizations (not just 2 or 3), other percentages may be used (e.g., three portions of 33%), any or all portions need not be equal, and players may split into numerous different types of re-characterizations described herein (not just "Big Win" and "Giant Win").

Card-Matching Bets—Ex: A player of a baccarat game may place a wager on a card-matching outcome involving cards in play. For example, the outcome may use cards from both hands, sometimes including the hit cards as well. Exemplary matching outcomes that may be wagered on via re-characterization include: four of a kind (e.g., any four of the same value card, or four cards of a specific value, such as four eights), straight, flush, full house, straight flush, cards of the same color, or the like.

"Any Pair"/"Late Pair"—Ex: After the initial deal, the bettor can bet that his hand includes a pair (if it does not already, or if it does, perhaps he can bet that his hand will include three matching cards). If the hand in question includes a pair after the draw, the player is paid at adjusted odds (based at least in part on the post-deal expected value (EV) of his original bet and the likelihood of achieving a pair).

"Perfect Late Pair"—Ex: Same as "Late Pair," except cards must be a perfect match, and pays at longer odds.

"Tie-Breaker"/"Win or Tie"—Ex: A player may use an option that breaks any possible ties. For example, if the player has chosen to have a tie-breaker, the player is paid if the hand wagered on wins the hand OR on a tie, and the wager is collected if the hand loses.

"Draw to '9'"—Ex: After a player has seen a partial deal, the player may make a wager that the final total of his or her hand will be a predetermined number (e.g., the first two Player Cards total 5, a player may indicate or wager that the hit will bring the final to total to "9").

"Deny the Hit"/"Two-Card Hand"—Ex: A player may choose not to have one or more dealt cards count towards the final outcome. For instance, the first card dealt to Player is a "7". At this point, a player may indicate that any other cards dealt to the Player hand do not count (i.e., he or she locks the "7" as the player hand total).

"Take Down"—Ex: A player may be able to rescue a losing wager by pulling back all or a portion of a wager. For example, by playing a "Take Down" token, a player in a disadvantageous situation can remove half of his original bet, with the remaining half paying an adjusted payout upon win.

"Sure Thing"/"Instant Win"/"Settle"—Ex: After betting $500 on "player," a baccarat bettor sees after the first four cards are dealt that his bet is at an advantage (e.g., he is ahead 7-3). Rather than risk losing the bet to a bad beat, the bettor places an "Instant Win" token. This token settles the bet for its Expected Value (EV), minus a house edge (though the amount subtracted from the EV may consider other factors, such as player status). This "locks in" the player's win.

"Free 6"—bettor can request a "Free 6" in baccarat after seeing the initial deal. Ties may result in a push, or may result in the bettor's loss. Wins are paid at an adjusted rate.

"10 is a 2"—Ex: After the initial deal, the bettor can play a "10 is a 2" token and turn all 10-value cards (e.g., face cards or 10s) for the side he has bet on into a "2". Any card value can be changed to any other card value with this mechanic. Wins are paid at an adjusted rate.

"Pushes Lose"/"Ties Lose"/"No Tie"—Ex: After the initial deal, the bettor can play a "Pushes Lose" token. If he wins, he is paid at better odds. If he ties, his bet is lost.

"Pushes Win"/"Ties Win"—Ex: After the initial deal, the bettor can play a "Ties Win" token. If his hand ties or exceeds the opposing hand, his bet wins, but is paid at an adjusted rate.

"Hop Bets" (e.g., 9-0)—Ex: After the initial deal, the bettor can bet that the current hand will resolve to a particular point score on both sides (e.g., 9-0). The bet can be re-characterized to wager on any such specific score, or range of scores. Each would pay at its own adjusted odds.

"Long Shot"—Ex: After the initial deal, the table can calculate the "longest shot" in terms of point score on both sides, and offer this bet. Players can re-characterize and bet only on this long-shot, which pays at high odds.

"Win Two Ways"—Ex: After the initial deal, the bettor plays a "Win Two Ways" token. First, the side he originally chose must win according to standard baccarat rules. However, the same side must also win according to a cumulative count of the card values in each hand (e.g., 5-7-3 is a "15" by this count, in contrast to being counted as a "5" in standard baccarat rules). If the bettor wins both of these, he is paid at adjusted odds. Winning only one of the two ways is not enough, and the bettor loses his bet.

"Freeze"—Ex: in some situations, a player may be dealt a preferable hand, but because of the strict draw rules in baccarat, the hand ends early. For example, a deal with a Player hand of 6 and a Banker hand of 7 ends after the deal. In such a situation, a player may place a "freeze" token to allow her wager or hand total to roll into the next hand. For example, a player bets on Player and the initial deal is 7-7. The player places a freeze token on his wager which carries the player total of 7 into the next hand. The player's payout is rated in the next hand and she may be required to add additional value to the wager.

"Alternate Draw"/"Reach Back"—Ex: in some situations wherein a draw does not usually occur, a player may wish to force a draw. Wins may be paid at an adjusted rate. The extra card may come from the shoe, a previous hand, an electronic random number generator, or other source as desired.

"Split"/"Form Two Hands"—Ex: as is common in blackjack, a player may be able to split a two-card baccarat hand into separate hands, and play each separately against the opposing hand.

"No Zero"/"No Four"—Ex: a bettor wagers that his hand will not be of a certain final value, such as 0 or 4. An outcome of these values would result in a loss, even if it normally would have resulted in a tie or win. Other wins result in a higher adjusted payout.

"Get Close"—Ex: A bet is re-characterized such that a player wins if he/she gets "within 1" or "within 2," on either side of the opposing hand (or perhaps only the negative side).

"Two Losses"—Ex: Same as "Two in a Row," except bettor wagers that he will lose.

"Big Loss"/"Giant Loss"—Ex: Same as "Big Win"/"Giant Win," except bettor wagers that he will lose by the given margin.

"Win Win Plus"—Ex: The bettor bets that he will win the current hand, as well as the next hand. The second hand must be won by a greater margin than the first.

"Win by More"/"Improved Win"—Ex: If the bettor is up 2-0, and he plays a "Win by More" token, he must win the hand by a margin of 3 or more (more than the margin after an initial deal).

"Bet on Next Card"/"Monkey Hit"—Ex: The bettor can abandon his original wager and instead wager that the next card is a particular rank and/or suit (e.g., the next card has a value of "10").

"20 to 1"—Ex: For any given hand, a different re-characterization might pay 20:1, though the exact re-characterization required to pay this amount might change from hand to hand. The player simply places a "20 to 1" token or places his bet in a "20 to 1" circle and accepts whatever re-characterization is required.

"Best of Two Hands"—Ex: A baccarat bettor wagers on banker and is behind 0-4 after the first four cards are dealt. He chooses to utilize a "Best of Two Hands" re-characterization. If the banker position turns out to win either the current hand or the next hand, the bettor is paid a small adjusted payout. The player loses his bet only if both hands lose.

"Two Ways to Win"—Ex: A baccarat bettor wagers on player and is ahead 7-1 after the first four cards are dealt. He chooses to utilize a "Two Ways to Win" re-characterization. His bet now pays (i) a first adjusted amount should the player position end up winning or (ii) a second adjusted amount should a tie occur. The first and second adjusted amounts are based at least on the likelihood that either situation occurs (the player wins or a tie occurs). This provides players with a chance to win in different ways.

"Jackpot"/"Progressive"—Ex: a player re-characterizes his wager to an extremely unlikely outcome, such as "4×4♠" (the Player and Banker hands each feature two 4♠). This bet may pay a jackpot amount. The jackpot amount may be adjusted based on the odds of occurrence and a house edge (as other re-characterizations are), may be flat, may be "progressive" (increasing in size as funded by players, until it is hit), "personal" progressive (each individual builds toward his/her own jackpot), or some combination of these.

"Late Player"/"Late Banker"/"Late Tie"/"Late Action"—Ex: After seeing two or four cards dealt in a hand of baccarat, assuming no natural is in play, the player can place a late bet on "Player," "Banker" or "Tie," paying at adjusted odds.

A variety of late options related to a wager in baccarat are discussed in co-owned U.S. Provisional Patent Application Ser. No. 61/020,470, filed Jan. 11, 2008, entitled "Method and Apparatus for Playing Baccarat with Late Play Options" which is incorporated herein by reference for all purposes. Additional description of similar actions that may be performed in baccarat can be found in Applicant's co-pending U.S. Provisional Patent Application Ser. No. 60/939,263, filed May 21, 2007 and entitled "SYSTEMS, METHODS AND APPARATUS FOR ADDITIONAL GAME OPTIONS IN BLACKJACK, BACCARAT AND OTHER GAMES".

As alluded to above, the odds for the re-characterized wager are infrequently the 1:1 or 0.95:1 odds of the initial wager. Rather, the re-characterized wager may be paid out at odds that are determined by one or more of the following factors: (i) the probability that the re-characterized wager will result in a win (e.g., given factors such as a) the current cards in play, b) historic cards dealt from the same shoe (so as to mitigate the exposure to card counters), and c) the intermediate stage of the hand at which the re-characterization is made (a re-characterization placed with only one card in play will pay differently than one placed with four cards in play), (ii) the amount of the original bet, (iii) the amount of a second bet associated with the re-characterization (if applicable), (iv) the expected value (EV) of the original bet, (v) a player status rating (some players may receive better payouts than others), (vi) rules for rounding payouts to even amounts, and/or (vii) a house advantage (the house pays winning re-characterizations "EV minus a given house advantage, plus/minus any modifications for player status"). The modified odds are sometimes referred to herein as the adjusted odds or the rated odds. Similarly, the payout may sometimes be referred to herein as the adjusted payout or the rated payout. When re-characterizations implicate a plurality of hands (e.g., as described below, "Two in a Row"), a house edge may be deducted once for each implicated hand (e.g., "Two in a Row" pays EV minus twice the house edge plus/minus adjustments for player status).

In one embodiment, all re-characterized bets are paid out at fixed adjusted odds, regardless of what cards are showing at the table. In another embodiment, the adjusted odds may vary depending on the nature of the re-characterization wager and/or the cards on display at the time the re-characterization wager is made (i.e., the cards shown are used to help calculate the expected value of the various re-characterization wagers). Because it may be difficult for the dealer and players to remember a large number of dynamic adjusted odds, the dealer and/or player may use a look up table or the like that shows what the odds are for a particular deal. For the simple embodiment shown in FIGS. 1-7, the look up table may be available for players and dealers to review in the form of a book. Each page of the book could have a different re-characterization wager on it with a table that shows all the possible hands and the odds. Additionally, a column or entry may be provided that describes the payout per $100 (or other desired denomination) wager. An example of such a page from such a book is presented in FIG. 9. When the intermediate outcome is revealed, the player and/or the dealer may refer to the look up table and determine the odds and the potential payout for the wager stack 46 that the player currently controls for a given deal. Based on the published odds, the player may decide whether or not to re-characterize the bet. Again, it is worth noting that the odds for the re-characterized wager may be more favorable for the gaming establishment than the normal house edge for the game.

The adjusted payouts may further take into consideration rules for rounding payouts to even amounts so that fractional amounts do not have to be tracked. A rules based system of a computing device may dynamically determine (i) a direction for rounding (up or down) and/or (ii) a denomination to round to based on numerous factors, such as (a) recent rounding decisions, such that an overall advantage is maintained across numerous instances of rounding (e.g., some round up, some round down, resulting in an average); (b) the player's bet amount, and the like. A recent history of payouts considered for rounding may be associated with a casino, table, player or other element. However, this sort of historical tracking may be difficult to implement on the table 10 and is more suited to the smart table 150 described in greater detail below.

In summary, re-characterizing a bet may change a condition for payout such as by making a condition for payout more restrictive (in which case, the payouts may be increased), less restrictive (in which case, the payouts may be decreased), or have comparable likelihood of occurring. Additionally, the player may choose to add winning events to the wager in play such that the player may receive two payouts. This embodiment is particularly useful for split type re-characterizations. Examples include initially wagering on banker and then re-characterizing through a split the wager as a "Banker 9" wager. Thus, the player may win a first amount if the banker wins and a second amount if the banker wins with a 9. Re-characterization may increase or decrease the likelihood that a player wins. As noted, the payouts may increase or decrease accordingly to preserve a desired house edge.

Electronic Table

Figure 10:
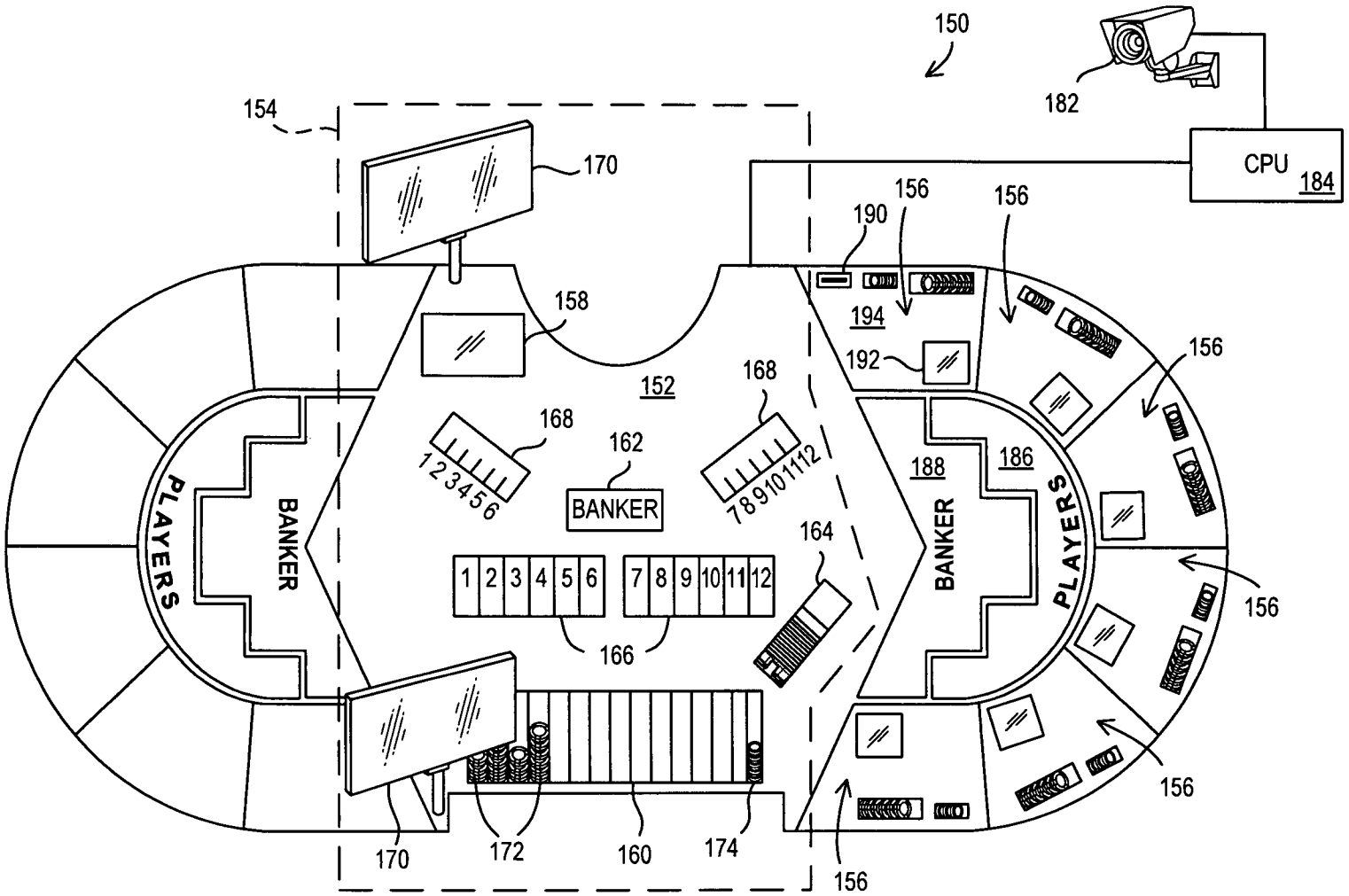
FIG. 10 illustrates a top planar view of a smart table.

While the above discussion has focused on providing embodiments of the present disclosure without requiring any hardware changes or changes to the table 10, there is no reason why the table must remain unchanged. For establishments that are willing to have a more expensive table, various electronic components may be added to the table to improve efficiency and ease the implementation of bet re-characterization. It should be appreciated that there is a continuum between the simple table 10 presented above and one that has all the proverbial bells and whistles. A more robust table 150 is presented in FIG. 10.

The table 150 has a planar top surface 152 on which game play takes place. The table 150 further has a dealer station 154 and at least one player station 156. The dealer station 154 has space for the various dealers to stand or sit and may include a dealer monitor 158, a chip rack 160, a banker hand area 162, a shoe 164, a commission recordation area 166, and a tie wager area 168. Additionally, monitors 170 may be positioned proximate the dealer station 154 in such a manner that all the players may perceive the monitors 170. While two are shown, it should be appreciated that more or fewer may be used as desired. The present disclosure also sometimes refers to the monitors 170 as a tote board.

The dealer monitor 158 and the monitors 170 may be displays as that term is defined in the Rules of Interpretation set forth below. It is particularly contemplated that the dealer monitor 158 has touch screen functionality. Alternatively a keyboard or other input mechanism may be provided (not shown). The dealer monitor 158 may be used to inform the dealer which players are owed how much as a payout on re-characterized bets and/or normal bets. Additionally, the dealer monitor 158 may inform the dealer when to hit the player hand or banker hand, what the point totals are, how much is owed by players for commissions, how many comp points are due a particular player, how much a player has won or lost, whether a player is trying to make a re-characterization bet that is valid or invalid, or other information as desired.

The monitors 170 may be used to provide information about historical outcomes so that players may review the historical outcomes. Additionally, the monitor 170 may list what bet re-characterizations are available and the adjusted odds or payouts associated with any such re-characterization. If a particular bet re-characterization is not currently available, it may be grayed out, listed as "N/A" or otherwise denoted in such a manner that players may understand that the particular bet re-characterization is not available. Again, monitors 170 may be implemented in a variety of manners, not restricted to the number of monitors 170 appearing at a table or the type of monitor being used. Monitors 170 may take the form of a physical sign, perhaps with physically adjustable components to indicate changes to payouts or odds (e.g., an attendant can "call up" or swap in a new set of odds or payouts for a given re-characterization type and/or game circumstance by making a few simple changes).

Figure 11:
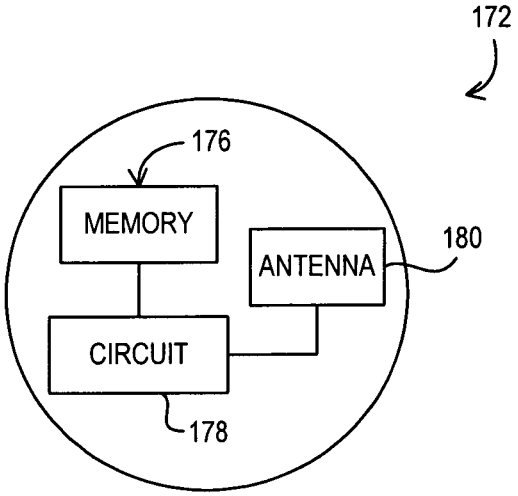
FIG. 11 illustrates a simplified schematic diagram of an RFID chip.
Figure 12:
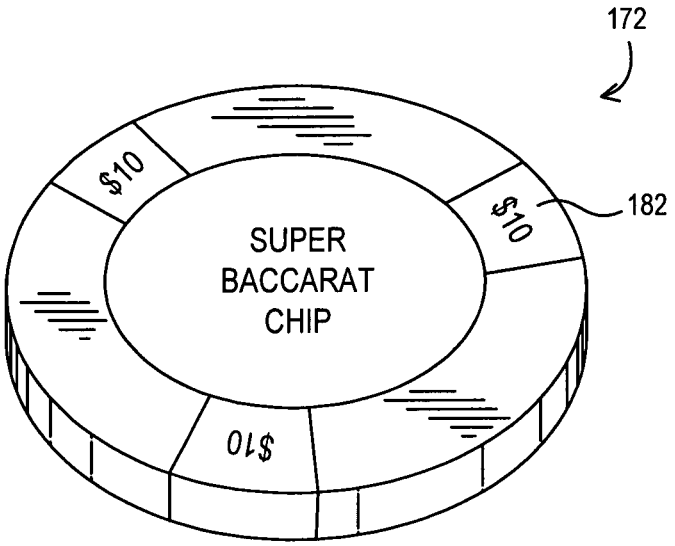
FIG. 12 illustrates a perspective view of the chip of FIG. 11.

Chips 172 (also illustrated in FIGS. 11 & 12) and tokens 174 may be positioned in the chip rack 160 and used throughout the table 150. The chips 172 may include a radio frequency identification (RFID) tag or memory 176 with an electronic circuit or processor 178 and an antenna 180 (see FIG. 11). The chip 172 may be similar or identical to those disclosed in U.S. Pat. Nos. 5,166,502; 5,676,376; 6,021,949; and 6,296,190, and U.S. Patent Application Publication Nos. 2004/0207156 and 2004/0219982 which are all incorporated by reference in their entireties. Gaming Partners International (GPI), of 1182 Industrial Road, Las Vegas, Nev. 89102 and Shuffle Master, Inc. of 1106 Palms Airport Drive, Las Vegas Nev. 89119 both sell RFID chips suitable for use with the table 150, although neither product is specifically required to practice the concepts of the present disclosure. The GPI chip uses a standard microchip made by Philips Semiconductors called the Vegas S, each of which has a unique serial number. The gaming establishment (e.g., casino) or other entity may associate values with each serial number. The association may be in a look-up table or the like. Alternatively, the unique identifier may be encoded to include information therein. Likewise, the chips 172 may be color-coded or include other indicia, such as indicia 182 (FIG. 12) that indicate values to the player or dealer. In some embodiments, plaques may be used instead of chips (e.g., for exceedingly large denominations).

In use, the electronic circuit 178 and antenna 180 act as a transponder capable of responding to an interrogator (not shown). In essence, the interrogator sends out an electromagnetic signal that impinges upon the antenna 180, exciting a current within electronic circuit 178. In response to the excited current, the electronic circuit 178 causes the antenna 180 to emit a second electromagnetic signal as a response, which is received by the interrogator. The second signal has identifying information about the chip 172 encoded therein such that the interrogator can identify the chip on receipt of the second signal. The second signal may be generated passively or actively. That is, in a first embodiment, the energy from the interrogation signal provides sufficient power for the electronic circuit 178 to use to send the second signal. In a second embodiment, the electronic circuit 178 may include a battery or other power source, which is used to power the generation of the second signal. While batteries have increasingly small footprints and longer lives, it is generally more practical to have a passive transponder.

It is further contemplated that the tokens 32 may be RFID tokens, each having its own unique identifier. A database may link the unique identifier with a particular bet re-characterization and other information as desired. For example, the database may detail to whom the token 32 was issued, any wager restrictions, any time of use restrictions, a cost associated with the token 32, or other information.

A camera 182 may be positioned over the table 150 and operatively connected to a central processing unit (CPU) or processor 184 associated with the table 152. The CPU 184 may be a control system as that term is defined in the Rules of Interpretation provided below and may control and coordinate the functions of the various components of the table 150.

The chip rack 160 may include an RFID interrogator. An exemplary chip rack of this sort is made by GPI under the trade name CHIP BANK READER. Alternatively, the interrogators described in U.S. Pat. Nos. 4,814,589; 5,283,422; 5,367,148; 5,651,548; and 5,735,742—all of which are incorporated herein by reference in their entireties—could be used. Another RFID tag and interrogator suitable for use with at least some embodiments of the present disclosure are produced by Texas Instruments as the TAG-IT™ product line. An improved interrogator is discussed in U.S. Patent Application Publication 2006/0077036, which is also incorporated by reference in its entirety.

The shoe 164 may be an intelligent shoe such as the IS-T1™ and IS-B1™ or the MD1, MD2 sold by Shuffle Master or comparable devices. The shoe 164 may be able to determine which cards are being dealt to which player station through RFID technology, image recognition, a printed code on the card (such as a barcode), or the like. The particular technique used to recognize cards is not central to the present disclosure. Further information about intelligent shoes may be found in U.S. Pat. Nos. 5,941,769 and 7,029,009, both of which are incorporated by reference in their entireties and U.S. Patent Application Publications 2005/0026681; 2001/7862227; 2005/0051955; 2005/0113166; 2005/0219200; 2004/0207156; and 2005/0062226 all of which are incorporated by reference in their entireties. In place of an intelligent shoe, cameras, such as camera 182 may be used with pattern recognition software to detect what cards have been dealt to what player stations, what chips 172 have been wagered, and what tokens 32 have been used by particular player stations. One method for reading data from playing cards at table games is taught by German Patent Application No. P44 39 502.7. Other methods are taught by U.S. Patent Application Publication 2007/0052167 both of which are incorporated by reference in their entirety. Similarly, cameras 182 may be used to detect when a token was given or removed from a specific player. This information may be helpful should the gaming establishment need to audit a session.

In some embodiments, an intelligent shoe may indicate to a dealer whether or not a card may be taken from it. For example, if cards that have previously been dealt have not yet been overturned, or there is a problem with a player's bet, a red LED associated with the shoe may illuminate. When a dealer is allowed to take another card, a green LED may illuminate. The shoe may even physically prevent the dealer from taking a card if the system determines this is appropriate.

The player station 156 may include a player bet area 186, a banker bet area 188, a player tracking mechanism 190, a player monitor 192, and a chip reserve area 194. As before the player bet area 186 and the banker bet area 188 are delimited by indicia onto which the player may place a wager stack 46. However, the player bet area 186 may include one or more interrogators 196 (FIG. 13) which detect chips 172 and tokens 32 placed in the player bet area 186. Likewise, the banker bet area 188 may include one or more interrogators 198 (FIG. 13) which detect chips 172 and tokens 32 placed in the banker bet area 188.

The player tracking mechanism 190 may be a card reader adapted to receive a magnetic stripe card such as is commonly used in gaming establishments. Alternatively, the player tracking mechanism 190 may be a smart card reader, an RFID interrogator that interrogates a player tracking RFID fob, TITO device (for reading player data encoded on a ticket), or other device as desired.

The player monitor 192 may be a display as that term is defined in the Rules of Interpretation set forth below. The player monitor 192 may be a touch screen display and/or have associated input elements such as a keypad or keyboard. Collectively, the player monitor 192 and any associated input elements are termed a player interface. Information about the player, about the available bet re-characterizations, a history of outcomes, any adjusted odds or payouts for a particular available bet re-characterization, or other information may be presented on the player monitor 192 as described herein. In a first embodiment, each player station 156 has its own monitor 192. While not shown, the player station 156 may also include a bill acceptor and/or a cashless gaming receipt device such as the TITO bill validating device such as a FutureLogic GEN2™ PSA-66 device configured to operate within an EZ-PAY™ system by IGT. Another variation is to use a mobile terminal such as a personal digital assistant, palm-style computer, cellular phone, hand held or laptop computer as a display.

Figure 13:
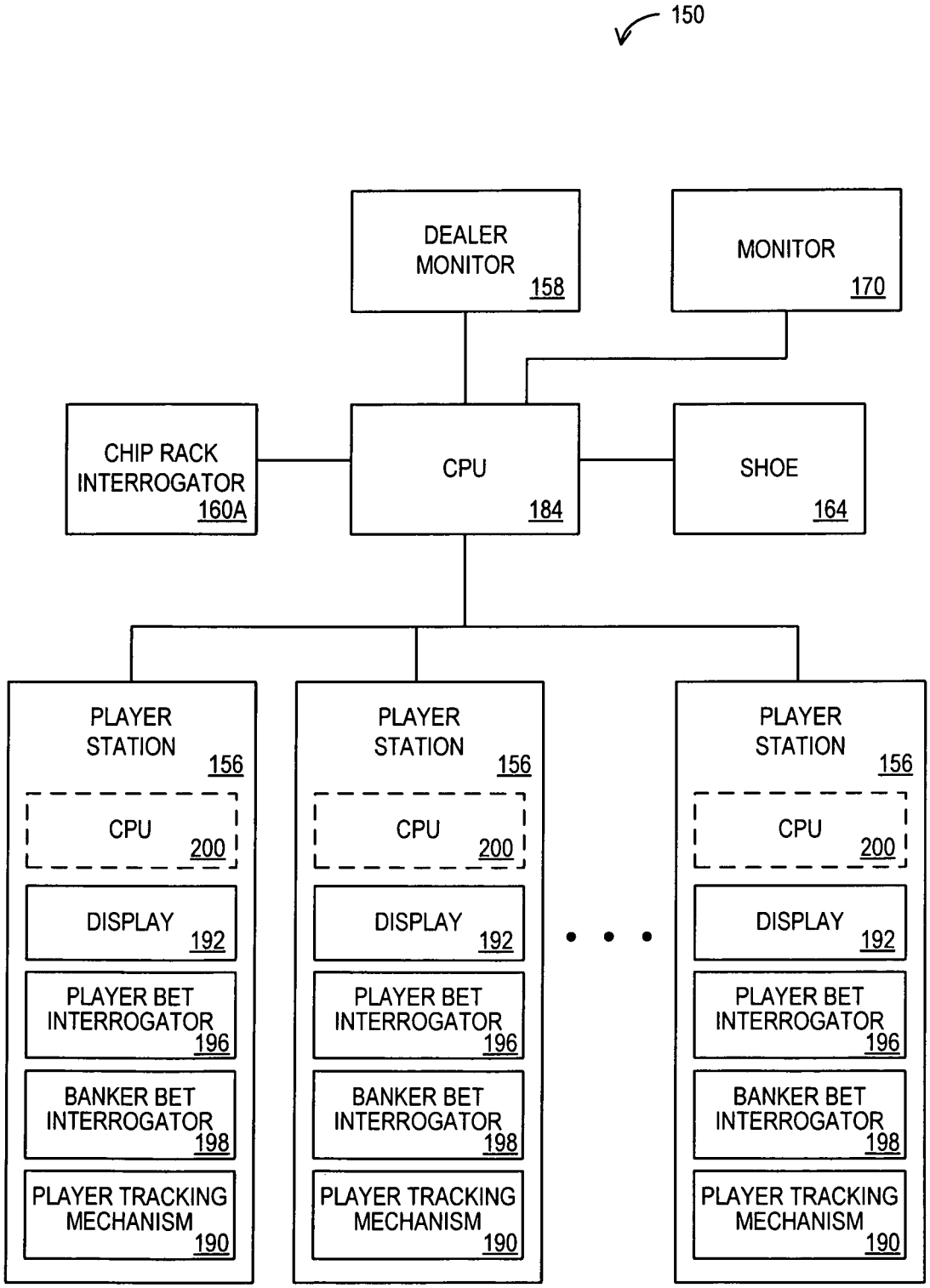
FIG. 13 illustrates a block diagram of the table of FIG. 10.

The various electronic components of the table 150 may communicate with one another as better illustrated by the block diagram of FIG. 13. The CPU 184 may act as the main processor or "brains" of the table 150. The CPU 184 may be part of the table 150 or may be remotely positioned therefrom. It is possible that the CPU 184 may be a central server that controls multiple tables concurrently if desired. The CPU 184 may be communicatively coupled to the various components through a network (not labeled) as that term is defined in the Rules of Interpretation set forth below, a bus, or other communication system as desired.

The CPU 184 may control all the various components and perform all the calculations according to software stored in a computer readable format in a memory unit (not shown). For example, the CPU 184 may receive data from the shoe 164 and or the interrogator 160A associated with the chip rack 160. Likewise, the CPU 184 may control the player tracking mechanisms 190, the monitors 192 and any sensors that track bets such as player bet interrogator 196 or banker bet interrogator 198. Alternatively, functions specific to individual player stations 156 such as control of the monitor 192, interpretation of data from the interrogators 196, 198 and the like may be controlled by player station processors 200. As yet another alternative (not illustrated), a single player station processor 200 may control all the player stations and a second CPU 184 control the table such that the single player station processor 200 is a client for the CPU 184.

While the table 150 is particularly contemplated, it may be possible to modify an existing table to include the functionality of some or all of the embodiments of the present disclosure. For example, PGI, with Shuffle Master and IGT, sells an intelligent table under the moniker INTELLIGENT TABLE SYSTEM™ together with software entitled TABLE MANAGER™. Other intelligent table systems sold by Progressive include the TABLELINK PLAYER TRACKING, TABLELINK CHIP TRACKING, TABLELINK GAME TRACKING, TABLELINK TOTALVIEW, and TABLELINK CUBE. Further intelligent table teachings can be found in U.S. Pat. No. 5,779,546 (outputting instructions to a dealer via a display screen); U.S. Pat. No. 6,676,517 and U.S. Pat. No. 7,011,309 as well as U.S. patent Application Publications 2002/0147042; 2003/0003997; 2005/0026680; 2005/0051965; 2005/0054408; 2006/0014577 (player-specific push buttons and display screens in communication with a table game computer); 2006/0205472 (touch-screen displays allowing player/dealer input at table games); 2007/0026930 (automated table game), all of which are incorporated by reference in their entireties. Likewise, instead of all the sensors described herein, the dealer may provide a running commentary that is transcribed and provided to the CPU 184, thereby providing the same information to the CPU 184. One such system is the BLOODHOUND system sold by Shuffle Master. It should also be noted that such technology may be repurposed for use by players to request certain actions (bets, re-characterizations, etc.).

Against such an automated table 150, the dealer's tasks and record keeping associated with the play session are greatly eased and facilitated by the automation of the table. An example of an exemplary method of using such a table 150 is presented with reference to the flow chart of FIG. 14.

The player initially approaches the table 150 (block 250). The player inserts her player tracking card (block 252) into the player tracking mechanism or otherwise provides player tracking information. Alternatively, if the dealer recognizes the player, the dealer (or pit boss) may enter the sufficient information to identify the player to the CPU 184. A player history may be accessed by the CPU 184 (block 254). The CPU 184 may access information stored on a central server associated with the gaming establishment to access or find the player history information. Any player preferences may be retrieved if they are stored by the gaming establishment. Likewise, any credit limits, player ratings, or other relevant information may be retrieved. Based on the player history information and/or a player request, the dealer may issue chips 172 and bet re-characterization tokens 32 to the player (block 256). The dealer may link the RFID identifiers of each chip and token so issued to the player station 156 to which the chips and tokens are being issued, to the particular player identifier to which the chips and tokens are being issued, or the like (block 258), although such is not strictly required.

The dealer may indicate that wagers are being accepted, and the player may place an initial wager (block 260). The CPU 184 determines and registers or stores an indication of the amount of the wager through the appropriate interrogator 196, 198, the camera 182, or similar mechanism (block 262). The dealer deals the cards (block 264). The shoe 164, the camera 182, or other mechanism is used by the CPU 184 to determine what cards were dealt to the player and what cards were dealt to the banker (block 266) and this information is stored.

Based on the cards dealt, the CPU 184 may calculate, look up, or otherwise determine what would be appropriate adjusted odds for all available re-characterized bets (block 268). For each available re-characterized bet, the CPU 184 may then publish the adjusted odds on the monitor 170 (block 270).

Figure 15:
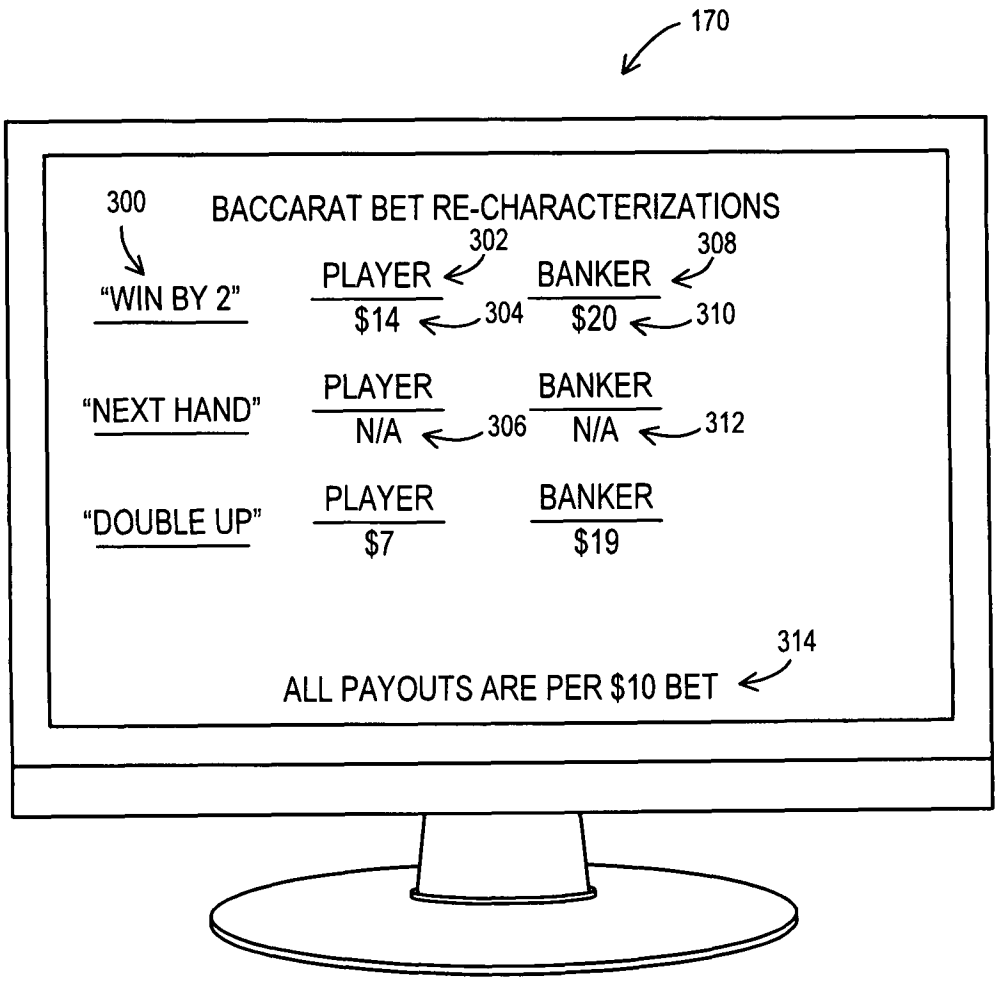
FIG. 15 illustrates a screen shot of a monitor from the table of FIG. 10.

An exemplary screen shot from monitor 170 is illustrated in FIG. 15. Specifically, the monitor 170 displays the name of the re-characterized bet 300, a player column 302 and a banker column 308. For example, a win by two re-characterized bet shows that a $10 wager pays $14 (element 304) in player column 302 and pays $20 (element 310) in banker column 308. Likewise, the next hand re-characterized bet is not available (element 306 and 312) in both player and banker columns 302, 308). Additional information 314 may be provided as a legend or the like to help explain the basis of the number in the columns. In this example, the numbers are based on a $10 wager (payouts are expressed as a function of a hypothetical bet amount). Other methods of expressing adjusted payout amounts include: (i) expressing a net payout considering an individual player's wager, (ii) expressing a gross payout considering an individual player's wager, or (iii) a "Bet X to win Y" relationship or ratio that expresses how much must be bet to win a certain amount. In an alternate embodiment, only re-characterizations of the player's existing bet are displayed. Since this information is personalized, it may make more sense to display this information on the player display 192. Since the information is personalized, the payouts for the re-characterization may be personalized to show what each re-characterization would pay. Additionally, for some wagers, a graphically-represented "slider" may be provided allowing the player to see how much a wager of X amount would pay.

Figure 16:
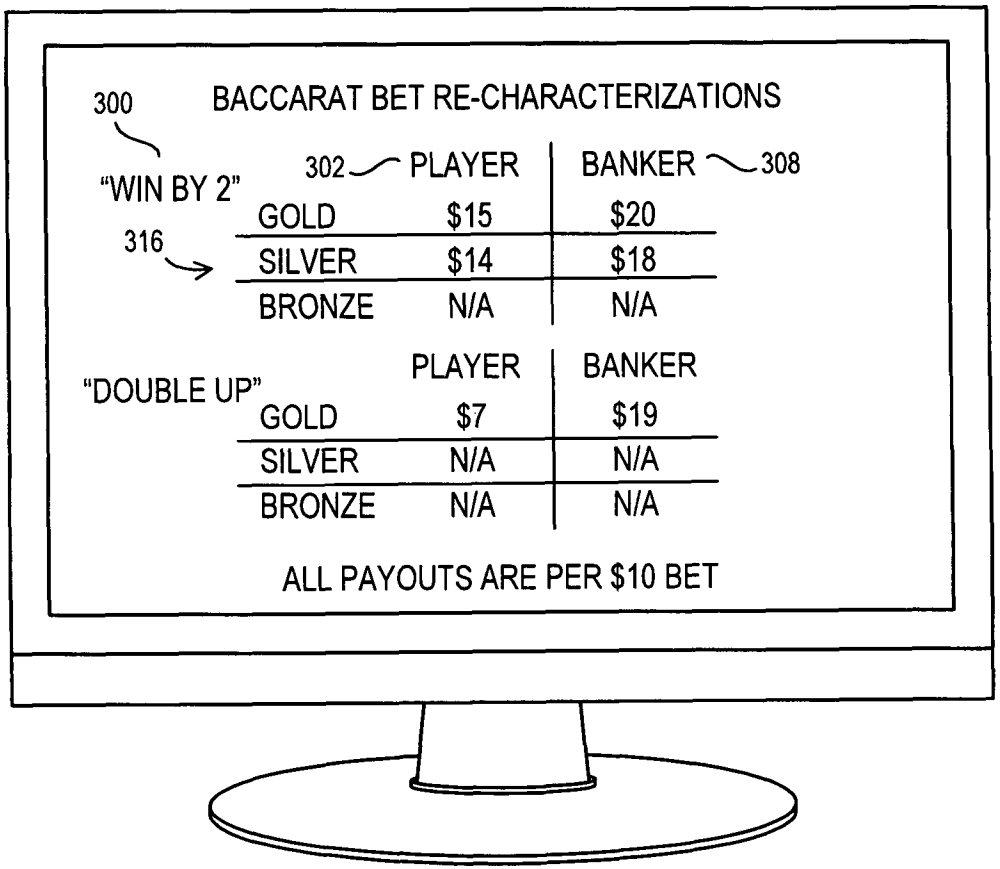
FIG. 16 illustrates an alternate screen shot of a monitor from the table of FIG. 10.

By having the player information, some additional variations may be provided. In particular, the gaming establishment may make the bet re-characterizations more attractive to its best customers. In particular, the CPU 184 may not only publish the general adjusted odds on the monitor 170, but it may also publish adjusted odds based on the level of the player as illustrated in FIG. 16. In the illustrated screen shot, the columns 302 and 308 are further divided (element 316) by level of player, where gold level players have better adjusted odds than silver level players, and bronze level players are not eligible to place either wager.

Figure 17:
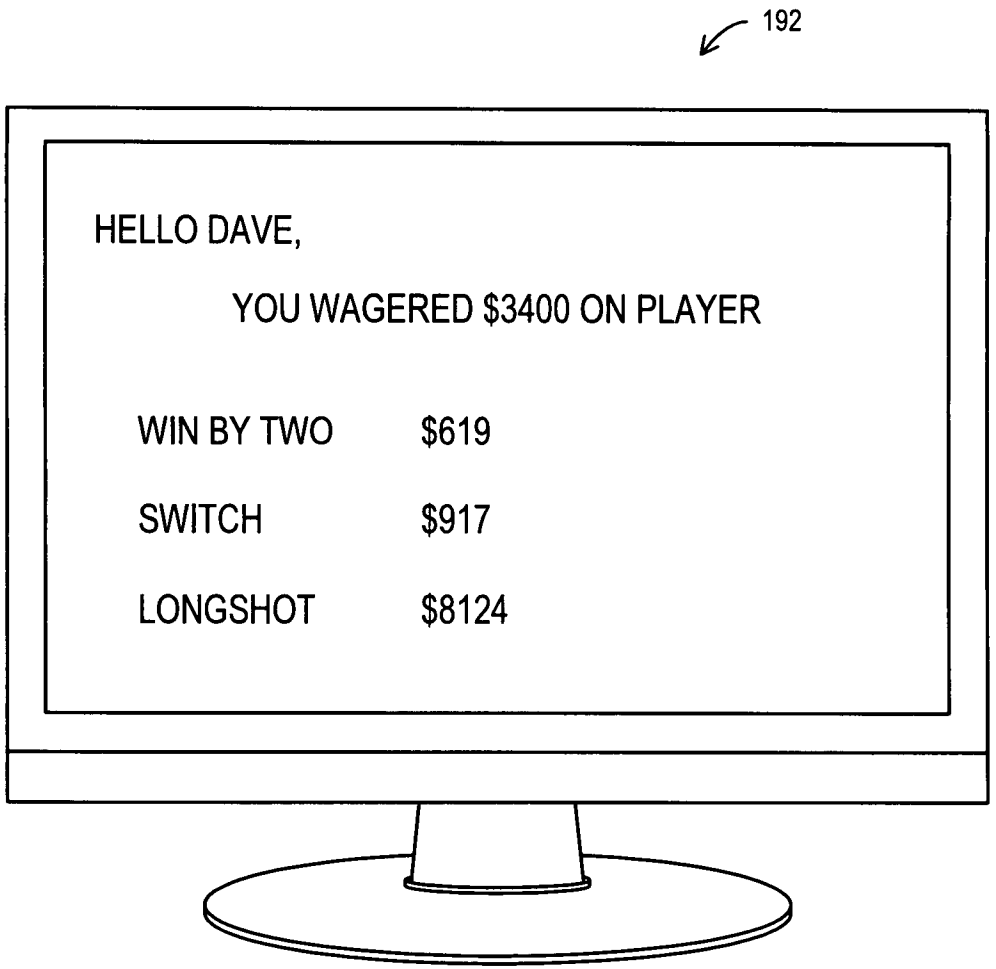
FIG. 17 illustrates another alternate screen shot from a monitor from the table of FIG. 10.

Note that the information on the monitor 170 may be published on the player monitors 192. Alternatively, each player monitor 192 may provide personalized information about what re-characterization wagers are available for that player and at what odds. Likewise, because the player's wager is known by the CPU, the particular adjusted odds may be published to the player based on the player's wager. An exemplary screen shot is presented in FIG. 17. A personal greeting may be provided which acknowledges the amount and type of wager the player made as well as lists the re-characterized wagers available to the player and what the payout for each would be.

Figure 14:
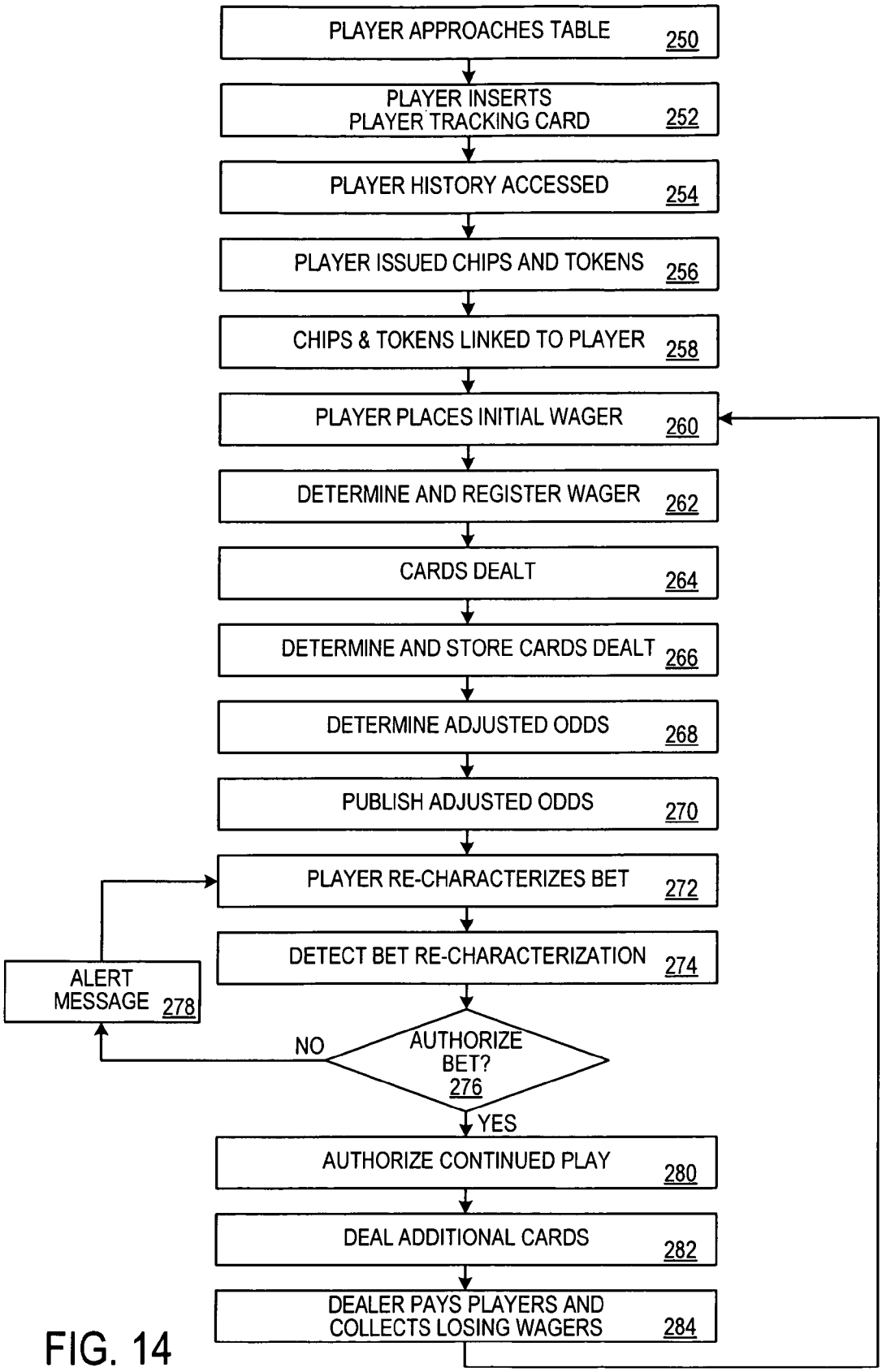
FIG. 14 illustrates a flow chart showing an exemplary method of use of the table of FIG. 10.

Returning to the flow chart of FIG. 14, the player places a re-characterization token 32 on the wager stack 46 of chips 172 (block 272). Again note that the player may not handle the re-characterization token 32. Rather the player may indicate orally, through an electronic entry via the monitor 192, with a hand gesture or other technique that a bet re-characterization is desired, and the dealer may place the token 32 on the wager stack 46. The CPU 184 may detect the use of the token 32 through the appropriate interrogator 196, 198 (block 274). If the wager stack 46 and the token 32 move from one area to a second area such as in a switch bet, this movement or at least the final resting place would be detected and confirmed on one or more monitors 158, 170, and/or 192. The CPU 184 may store information associated with this event in memory. For example, a time stamp, a player identifier, a token identifier, a wager amount, and other information may all be stored. The CPU 184 may determine if the player is authorized to make that particular bet re-characterization (block 276) based on the information stored about the player and/or the bet re-characterization that the player is attempting to make, and if the player is not so authorized, a warning message may be presented (block 278) such as by displaying the message to the player through the player monitor 192, the dealer display 158, an audible tone sounding, or the like as desired.

Once an appropriate amount of time has passed, the CPU 184 may detect no further bet re-characterizations and may authorize the dealer to continue play (block 280). Alternatively, the dealer may visually inspect the table 150 and determine that no further bet re-characterizations are to be made and continue play. Still another variation is that the dealer may orally inform the players that no further bet re-characterizations will be accepted and continue play. The dealer deals the additional cards as required by the rules of baccarat (block 282). Again, the cards are detected by the appropriate mechanism (e.g., the shoe 164, camera 182) and the CPU 184 is updated as to what hands have what values. Based on the known value of the hands, and the known wagers, and the known re-characterized wagers, the CPU 184 may indicate what wagers are winning wagers, what wagers are losing wagers, and how much should be paid to each winning player. This indication may be provided through the dealer monitor 158, the monitors 170, and/or the player monitors 192 as desired. The dealer then pays the winning players and collects the losing wagers (block 284). Note that commissions owed may be indicated in real time on the player monitor 192 or other location as desired. If appropriate, the CPU 184 may adjust the value of a payout to collect an owed commission, and the player may be informed of this changed payout.

The CPU 184 may update the player history, update commission owed data, or perform any other administrative task necessary, and the process repeats as indicated. When the player leaves the table, the CPU 184 may provide an indication of the commissions owed, and the player may settle such debt accordingly.

Note that for circumstances where the initial wager is split (or there are otherwise two wager stacks) the interrogators 196, 198 may need to have two interrogators for each bet location so that the CPU 184 may discriminate between which portion of the bet is the diminished initial wager and which portion has been re-characterized. Alternatively, the dealer may make such an indication through a BLOODHOUND system, the cameras 182 may detect the different stacks, or other technique as desired.

It should be appreciated that many activities that were the dealer's responsibility for the table 10 may be automated for table 150. For example, if a wager stack 46 is moved, such as in a "switch" bet, the interrogators may detect the new location of the wager stack as well as the placement of the re-characterization token in the new location. This information is passed to the CPU 184, and the re-characterization bet is registered. Likewise, the monitors 170, 192 may be used to inform the players what a particular color token means. This information may be especially important in any embodiment where the tokens change meaning between hands (the reader may remember the embodiment described above where in a first hand, a brown token was a win by two re-characterization, and in the second hand, the brown token was a long shot re-characterization).

As an aside, the CPU 184 may impute a number of active players based on the number of wager stacks 46, number of tokens 32 in play, or other activity. This imputation may be helpful where a player does not have a player tracking card or the dealer forgets to enter player information when the player sits down.

In some embodiments, an electronic table may comprise a fully virtual table, featuring electronic or simulated cards, chips, dealer and/or outcome determination (e.g., an electronic roulette wheel as opposed to a mechanical wheel). Of course, not all components may be virtual (e.g., a physical roulette wheel communicates with an otherwise virtual table). Numerous such devices are contemplated. For example, Shuffle Master manufactures a multiplayer electronic table marketed as the TABLE MASTER. In some embodiments, memory of a computing device associated with such a table may be loaded with software for executing steps of the present disclosure. For example, display screens with which players may interact allow for selection of re-characterizations, whether by using virtual tokens or selecting some other virtual representation (e.g., a graphical box) indicating an available re-characterization. Wagers and payouts may occur in electronic credits.

In still further embodiments, a plurality of electronic betting terminals may communicate with a single outcome generation source, whether a live or simulated baccarat dealer, live or simulated blackjack (or pontoon) dealer, physical of virtual roulette wheel, or the like. Paradise Entertainment Limited of Macau manufactures such a terminal-based baccarat network incorporating a live dealer (LIVE Baccarat).

Intermediate Table

Figure 18:
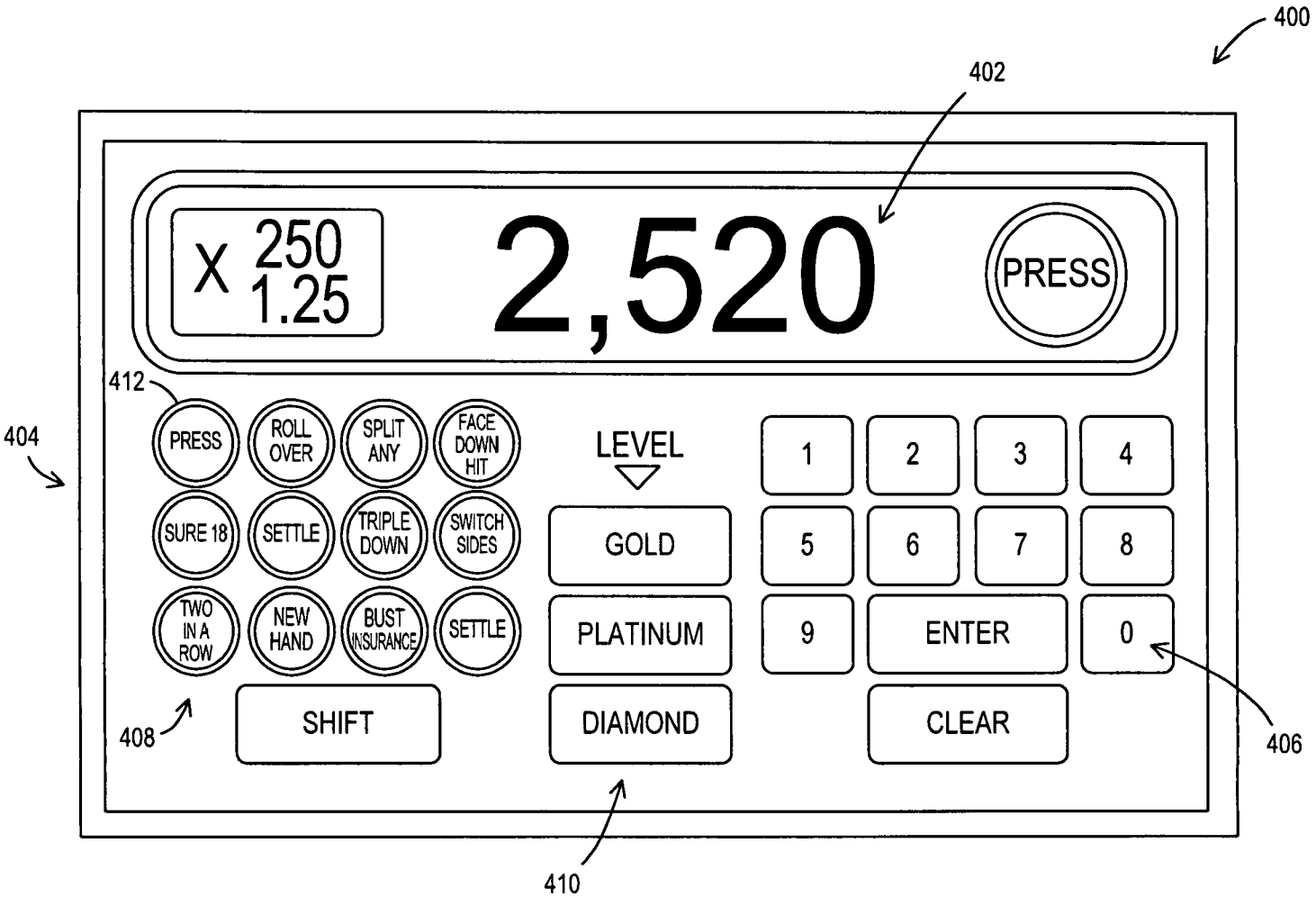
FIG. 18 illustrates an adjusted payout calculator.

Short of the electronic table 150, but more advanced than the table 10, there are numerous intermediate tables where some of the functions that would be attributed to the dealer might be automated. For example, instead of monitors 158 and 192, players and dealers may be provided calculators to assist them in determining adjusted payouts. In one embodiment, such calculators may be stationary or part of the table (perhaps implemented through dealer display 158). In a second embodiment, the calculators are mobile terminals 400 (see FIG. 18). The mobile terminal 400 has a control system (not shown) with associated memory to contain software adapted to perform the functions described herein. The mobile terminal 400 further has a user interface with a display 402 and a keypad 404. Alternatively, a display may include touch screen functionality. The keypads may include a numeric keypad 406 for entry of wager amounts, bet keypad 408 for entry of the type of bet re-characterization, and a player rating keypad 410 for entry of the player level. The keys and display 402 may color code so that when a yellow press key 412 is pressed, the background of the display 402 turns yellow. The software may step a user through adjusted odds calculation. For example, a first screen may solicit entry of the banker hand; a second screen may solicit entry of the player hand; a third screen may solicit the amount and placement of the initial wager, and so on. The user then enters the desired bet re-characterization and the player level and receives information relating to an adjusted payout amount. The calculators may, or may not, have information about shoe composition and/or historical cards that have been dealt (or remain to be dealt) to provide payouts based on more complete expected value information. For example, a shoe may report cards dealt to the calculator, which tracks all the cards dealt and subtracts them from a remaining shoe composition deck when calculating payouts. Dealers may use this calculator before paying out bets; players may use this before making bets; and supervisors (e.g., with separate mobile terminals for validation) may use this to verify large payouts. For more information about such calculators, the interested reader is directed to U.S. Provisional Patent Application Ser. No. 61/024,850, entitled METHODS, SYSTEMS AND APPARATUS FOR SECURING AND MONITORING DYNAMIC PAYOUT SYSTEMS, filed Jan. 30, 2008 and U.S. Provisional Patent Application Ser. No. 61/026,950 entitled METHODS, SYSTEMS AND APPARATUS FOR SECURING AND MONITORING DYNAMIC PAYOUT SYSTEMS, filed Feb. 7, 2008 which is hereby incorporated by reference in its entirety. The METHODS, SYSTEMS AND APPARATUS FOR SECURING AND MONITORING DYNAMIC PAYOUT SYSTEMS application also describes many security provisions which may be implemented to prevent cheating at the table.

Alternate Embodiments

Tokens

In addition to the tokens described above, other types of tokens may be used and may be appropriate for particular circumstances. One such other example of a token could be a token that is formed from a plurality of matched parts (e.g. a re-characterization token may snap apart into halves, thirds, fourths, etc.). This type of embodiment may be useful when an original bet is split between multiple outcome events or there are multiple wagers on which to place re-characterization tokens. E.g., re-characterization tokens may be sold in packages in order to regulate what types of outcomes a player may wager upon when splitting. Thus, two tokens may fit together or be stuck together (e.g., magnets, hook and loop fasteners such as VELCRO®, etc.) and indicate a package of outcome events, each of which can potentially cause the wager to be paid. Matched items may be used to indicate offsetting rules (in other words, one beneficial rule change and one negative rule change). E.g., a player may split his original blackjack bet into two equal stacks. On one stack he places the first half of a re-characterization token indicating that he needs to "win by 2." On the second stack of chips he places the second half of the re-characterization token indicating "no bust" insurance (if the player busts, he does not lose this stack). Alternate forms for the tokens include dice or other oddly shaped items, sleeves, or cards. Dice allow different bets to be placed on a single item. To identify the desired re-characterization bet, the player turns up the side of the die that has the desired bet re-characterization. Sleeves allow a player to wrap the initial wager with the sleeve to show it has been re-characterized. Cards allow the initial wager stack to be split. The chips above the card are the re-characterized portion and the chips below the card are the diminished initial portion (or vice versa).

In some embodiments, a re-characterization selector may be embedded within or otherwise attached to the table. A physical selector may allow for a player to select a re-characterization, such as by adjusting a slider, actuating a switch/lever, or spinning a wheel (such that the device points to the appropriate re-characterization). An electronic selector may incorporate touch-screen buttons that a player may use to select her choice.

Figure 19:
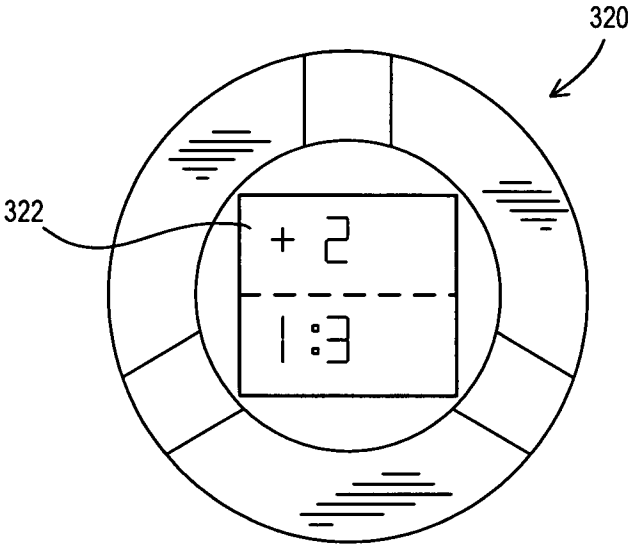
FIG. 19 illustrates an alternate re-characterization token.

In still another embodiment, the tokens may be electronic. For example, the tokens may have an electronic display associated with them. For example, as illustrated in FIG. 19, a token 320 may include an LED screen 322 which conveys the bet re-characterization type, the odds, and/or other information as desired. For more information about chips with such LED screens, the interested reader is directed to PCT Patent Application Serial No. PCT/US0779518, filed Sep. 26, 2007, SYSTEMS AND METHODS FOR PORTABLE WAGERING MEDIUMS which is hereby incorporated by reference in its entirety. An electronic token may feature electronic memory and communication means, such that the token may communicate with CPU 184, or with one or more RFID chips. For example, the token itself may indicate a re-characterization type to the CPU 184 or to the chips, which then might update hypothetical payouts accordingly. For example, a player may place an electronic "Add 2" token on top of a stack of $100 in RFID chips, thus indicating the desired re-characterization. Based on the desired re-characterization, the amount of chips in the stack, and the cards in play, the CPU 184 may indicate an adjusted gross payout of $184 on the $100 bet. Such tokens might be thought of as having the ability to talk down through any chips underneath them to the table, creating an opportunity to associate the entities electronically.

In another embodiment, instead of using tokens 32, the wager stack 46 may be simply moved to a different spot on the playing felt. Indicia may be provided for each available bet re-characterization, and the player moves the wager stack 46 to the desired re-characterization. Note that this embodiment has the side effect of changing the felt, which may be less attractive to some players. However, the success of the comparatively busy craps felt shows that players can adapt to more diverse betting options. If interrogators are used, each betting area may have its own interrogator so that such movement may be detected.

In still another embodiment, a player may be allowed to create her own token. Such a token may be created online and picked up during check-in, using a kiosk, or with the assistance of a gaming establishment representative. The token could reflect any particular rules for that player. Such a token is most easily effectuated with an RFID token, but other forms could be used. Using such a customized token, a customized re-characterized wager could be implemented, such as "switch and win by five". A player could update the token with a new re-characterized wager when desired (e.g., between hands). The information about the customized wager could be stored on the token if the token had sufficient memory, or in a database associated with the unique token identifier. Likewise, the player might update the information online.

Additionally, tokens may be used for alternate purposes. For example, a token may be used to reserve a player position. The reservation token is detected by an interrogator, and the player position is deactivated until the reservation token is removed. Players sitting at a deactivated player position may not receive re-characterization information or place wagers. The dealer may orally inform the player of the reservation and encourage the player to sit elsewhere if the player desires to play. Still another token is a player bonus token. If the player receives a bonus payout, the dealer may use the player bonus token to designate the bonus when it is paid so that the bonus balance is adjusted accordingly.

As the player may create his/her own re-characterizations, the house might (i) provide hypothetical payouts for those created by players, and/or (ii) use a central server to create its own custom re-characterizations. Software for creating and determining hypothetical payouts associated with re-characterization may utilize a re-characterization programming or markup language.

Back-Betting and Distinguishing Multiple Bets

The bet re-characterization concepts may also be extended to "back-betting" patrons (those not sitting at the table, but wagering from behind, perhaps by riding along on a seated player's bet). Such patrons might be given separate RFID betting circles on an electronic table, or one of the dealers may be assigned just to back bettors. Still other techniques may be used as desired. The presence of back bettors may give rise to the CPU 184 having to impute a number of active bettors at the table based on a number of distinct stacks, relative location of stacks, weight sensors, placement of tokens, and the like. Back-bettors may or may not want to accept the re-characterization of the player in front of them. So, in some embodiments, back-bettors may be given their own tokens. Or, back-bettors might use a token that toggles "on" or "off" whether or not a seated player's re-characterization applies to their bet or not, or even may indicate so verbally.

In some embodiments, CPU 184 may impute or determine that a plurality of different bets are placed within a single "circle" or area of the table. Whether placed by two different bettors (e.g., a seated bettor and a back-bettor) or a single better (e.g., a split re-characterization as described above), the system may determine that at least two distinct bets (stacks of chips) are placed by (i) determining, via one or more RFID interrogators or antennae, that there are a plurality of RFID-enabled tokens within the circle or area; and/or (ii) determining, through an optical camera, that a plurality of stacks are placed. Through a combination of such RFID and optical technology, it is even possible that the system may determine specific wager amounts associated with each stack.

As an additional measure to protect the gaming establishment profits, the CPU 184 may track all the cards that have been played from a shoe. If the computational requirements are particularly heavy, a portion of the cards may be tracked. Alternatively, the discarded cards may be calculated into the current adjusted odds, but offset by one or more hands. For example, at hand ten, the cards from hands one through eight may be evaluated, and at hand eleven, the cards from hands one through nine are evaluated, and so on. In the rare situation where a shoe has a strange distribution of cards, certain re-characterized wagers, such as "Press" may have lower adjusted odds so that a card counter cannot take undue advantage of the odd shoe.

Managing Volatility

Alternatively, there may be a cap or ceiling for payouts. The cap may be a fixed amount or relative to the initial wager (no re-characterized bet may pay more than 500:1 compared to the original wager), per player, or per table (e.g., aggregating the net potential payouts of multiple bets by a player or table for the various possible outcomes). In some embodiments, if a player re-characterizes his bet, and doing so would result in a win that surpasses a table's maximum bet or maximum payout, the excess may be returned to the player before the bet is booked. For example, if a player with a large bet uses a "Switch" token when he is behind, the resulting payout might break the cap. Accordingly, a portion of the player's bet maybe taken down such that it is not "wasted".

In some embodiments, if a player's bet or payout surpasses a predetermined limit, the house may institute a larger edge. In one embodiment, the house edge may scale as bet or payout amounts surpass such limits. In this manner, the house can attempt to insulate itself from the high volatility of extremely large bets.

Thus, the house edge used in calculating an adjusted payout amount may vary based on various particular factors. In one embodiment, an operator may simply adjust the house edge value (e.g., from 2.5% to 3.1%) when desired (e.g., using a central server). In another embodiment, the house edge may be dependent on the current date/time, business of the gaming floor, a player rating, or the like. As described above, the house edge may be increased for re-characterizations spanning numerous hands. Also, the house edge may be dependent upon an amount bet, as above. Further, the system may dynamically modify the house edge based on wagering trends associated with one or more tables (e.g., "Banker" has won 3 in a row, so the system expects that wagering will now be heavily weighted toward "Player" and can take a higher house edge on the bets).

The monitors 170 may list certain re-characterization bets as not available. This may be done as a function of time (e.g., a press bet is not available after 9 PM); as a function of cards already dealt (e.g., a player cannot take Quick 6 when he already has a 6); or to prevent bets that are grossly unappealing (e.g., a player bet $500 and the payout is $10). Still other reasons for showing a bet as not available exist such as player rating, wager size, or the like. For example, wagering trend information can also be used to enable/disable certain special bets (e.g., if wagers are above a predetermined threshold on the "Banker" side at a table, no more bets may be placed on this side). The decision to enable/disable a certain re-characterization, or to enforce various betting limits associated with such bets, can be supported by input from the pit boss (or via a dealer screen with a password). For example, the pit boss would have access to the maximum casino exposure, expected exposure, etc., and override a table lockout to allow additional betting at a particular house edge. In essence, the pit boss may have a real-time decision tool to allow layers of increased volatility in exchange for increased value (house edge). Personalized player monitors may indicate that only limited wagering will be allowed on certain bets, so players must put in their bets quickly or lose out on the opportunity. For disabled bets, if the opposing side of the bet receives more wagers, then the disabled bet may be made available. The monitors may list payouts in gross form or net form as desired. Players may be informed of how the monitors are programmed. Note that with net payouts, some payouts may appear negative.

In one embodiment, player status may influence the house's willingness to accept a large bet. For example, a highly-rated player may be allowed up book bets up to a larger maximum, may be paid at a lower house edge on amounts over the maximum, etc.

Other Games

While the present disclosure has focused on baccarat, and to a lesser extent on blackjack, it should be appreciated that the concepts disclosed herein may be applied to mini-baccarat tables, craps tables, roulette tables, Sic Bo, Pai Gow, and other games of chance. The invention can even be applied to slot machines. For example, after less than all of the reels have completed spinning, they may stop an offer the player a chance to re-characterize his original bet. For example, if a player can be thought of as betting on "any win" when he spins the reels, after two of five reels have spun, he can re-characterize to "No Winner," and be paid an adjusted rate if his outcome is not a winner. The invention might apply to video poker in the same manner.

Alternate Prizes

After re-characterizing bets, players may be given prizes other than standard gaming chips or credits. Other prizes may include comp points, goods, services, "free" or promotional play of other casino games, "dead" chips that must be wagered once before they are considered cashable (e.g., a tote board indicates a re-characterization payout of $5,000 in dead chips or $4,800 in standard chips), discounts or coupons, etc. So-called "progressive" jackpots may also be applied.

Outcome History

Commonly, baccarat tables feature an electronic display of outcome histories. Such a display may be enriched if bet re-characterizations are available. The display might track or highlight "hot" re-characterizations that have resulted in above-average player win. Going a step further, such re-characterization history information may be personalized; this would be facilitated by the existence of personalized monitors 192, or an entirely virtual table. For example, a player's personal screen may show her statistics for each re-characterization (number of wins, number of losses, win percentage, amount won, amount lost), such that she can ascertain which re-characterizations have yielded better results.

In addition or as an alternate to a personal screen that keeps players informed of their most successful or favorite re-characterizations, a "caddy" or service person may be provided to inform high rollers of their statistics. Caddies might use a handheld device to assist players in this regard.

"Workspace" for Configuring Hypothetical Re-Characterizations

Another element greatly facilitated by implementation involving player-specific monitors 192 or a virtual table: "requested" re-characterizations. For example, in a certain game circumstance, a player might like to know, "What would the house pay me if I changed my hand value to a 5? Or to a 4?". Conversely, midway through a hand, a player may wish to know, "How can I re-characterize my bet such that I am paid 10:1?". Player-specific displays can provide this information. Also, with personal screens, players might "test" different re-characterizations to see what they would be paid should they decide to re-characterize their bet in a certain manner. For example, a player may place an original wager and the hand may be at an intermediate stage. Before the dealer signals "no more bets" such that no further re-characterizations may be placed, the player, with the help of a personal screen, might test different re-characterizations to see how they might affect the player's specific bet (e.g., if the player were to re-characterize a $100 bet on "Banker" with a "Switch" to the "Player" hand given a certain combination of cards in play during the intermediate stage, a win would result in a gross payoff of $160). The player might browse the hypothetical result of various re-characterizations using the screen. For example, the player can scroll through different available re-characterizations (perhaps using touch-screen technology) to search for a re-characterization that pays at good odds and/or that would pay at least some minimum amount should the re-characterized wager be resolved in favor of the player. In another example, the player might add and remove different tokens to his bet, perhaps in combination, and the screen might show the player what his bet would hypothetically pay if it wins. In this manner players can "shop" for re-characterizations they like.

In one embodiment a separate betting circle may be used. Thus, players can "test" different re-characterizations in this circle, and then confirm them for the main circle once they decide. Extra RFID chips (e.g., for "Press") and/or tokens might be used in this circle.

In one embodiment, the player might use a stylus or other device to interact with such a screen. Such a stylus might allow input of commands by touching areas of the screen, or by receiving written text (e.g., the player writes in a bet amount).

The personal display may also allow players to toggle between various settings (e.g., displaying gross versus net payoff).

Once re-characterizations are "booked," a player might see a confirmation. The public tote board and/or private player screens may indicate such confirmation. For example, next to "Player 1," the word "Switch" may appear, or the selected re-characterization may be highlighted in some other manner.

When and How to "Publish" Adjusted Payouts

As described, a tote board (e.g., monitors 170 or 192) may be used to communicate adjusted payouts players can expect to win if they re-characterize bets in a certain manner. Depending on the sophistication of the system, these adjusted payouts may be "published" to the tote board in various manners (at various times). While an intelligent shoe 164 may communicate card data to CPU 184 as cards are removed from the shoe 164, it may not be appropriate to publish adjusted payout information for re-characterizations until one or more cards have been turned over or revealed. For example, in the game of baccarat, it is not uncommon for cards to be revealed or "squeezed" slowly, and it would be disadvantageous to disrupt this tradition by publishing payout information for re-characterization prematurely (and potentially ruining the suspense of the "squeeze"). Thus, in one embodiment, a dealer may wait for the first four cards of a round of baccarat to be overturned before sending a signal to CPU 184, perhaps via a dealer monitor or other input device (e.g., a "Publish" or "Update Board" button, not specifically shown by FIG. 10), instructing that it is now appropriate to publish the adjusted payout information for re-characterizations. In one embodiment, the dealer may press a button on the shoe 164 indicating that the shoe 164 should send the information or display the information. In other embodiments, a camera may be used to determine that one or more cards have been overturned, and transmit a signal to CPU 184 accordingly. It is specifically contemplated that an overhead camera system manufactured by Tangam Systems of Waterloo, Ontario, Canada (e.g., the TableEye21 or TableEyeBacc model) may be utilized for this, and perhaps other purposes.

Other Token Implementations

Still other techniques for implementing the concepts of the present disclosure are contemplated. For example, all bets may have tokens 32 positioned on them to start a game, and the removal of the token 32 signifies a bet re-characterization. Tokens 32 may act like a dead chip, needing to be washed through or used once before it gains a negotiable value. Combination of tokens 32 may be used to remove restrictions. For example, a win by two token may have a restriction that it cannot be used in a double down situation. A second token may remove that restriction in exchange for different adjusted odds. Of course, physical tokens may be obviated entirely (e.g., virtual tokens or other elements are shown as the player books re-characterizations through a personalized display screen).

Instead of initially signifying to a bet re-characterization after the cards have been dealt, players may instead place re-characterization option tokens before any cards are dealt. For example, a player places an optional switch token at the outset of the hand providing her the opportunity (or option) to switch sides midway through the hand, if so desired. If she does not enact the option and wins, she is paid at an adjusted rate (most likely lower). If she uses the options, she may also be paid an adjusted rate or the standard rate.

In still another embodiment, single tokens may reflect combinations of bet re-characterizations such as switch and press. Other examples include "Two in a Row and Win Big", "Pass and Win Big", and "Switch and Raise". Note that it is also possible to use two tokens (e.g., one switch token in combination with one raise token).

Audit Records

In addition to the security systems to prevent cheating, audit records may be created. Such audit records may come from the CPU 184, calculators provided to dealers and players, or other elements within the system as desired. Receipts may also be provided on request. These receipts may show the audit record. Audit records and/or receipts may be personalized (show a personal history of wins and losses, including success/failure with various re-characterizations and the like). Audit records may be provided to third parties, such as an insurer.

Promoting and Marketing Re-Characterizations

The system of the present invention can track popular re-characterizations and adjust the marketing/display of them accordingly. For example, re-characterizations shown by a public tote board or embedded player screen (both examples of monitors 170 as described herein) might evolve such that they suppress or promote re-characterizations that are unpopular or popular. For example, re-characterizations shown by private player screens might include the player's favorite or most successful historic re-characterizations.

In some embodiments, certain re-characterizations can be promoted using comp points or some other premium. That is, comp points may be awarded more liberally for players using bet re-characterizations. For example, for a limited time, "Face Down Hit" may be offered to blackjack players at "double comp points".

Managing Multi-Hand Re-Characterizations

Certain re-characterizations (e.g., "Pass," "Two in a Row") may be resolved over a plurality of hands. This persistence might be tracked in a number of ways. Markers or other objects may be used. For example, a clear cup or other object may be placed over the bet, imprisoning it until the next hand is resolved. Other such physical markers might be used (cards, tokens, counters, etc.). For example, a six-sided die may be used to indicate a persistent bet of six hands (each turn, the dealer turns the die so that the appropriate side faces upward, from "6" to "5" to "4," and so on). A simple lammer may be used for two-hand bets, with one side indicating "2" and the other side indicating "1" (or the like). In another embodiment, a separate area of the felt might also be used. For example, persistent bets form Hand A might migrate to a different section of the felt for Hand B such that new bets for Hand B can be booked without confusion. Counters might be used in this separate area to indicate how many hands remain before the bet is "unlocked" or paid. In one embodiment, the counter is a digital counter. In another embodiment, a physical counter is used. In another embodiment, separate areas of the felt are used to "count down" the bet toward its conclusion (the bet is moved from "3," to "2," to "1" hand remaining).

Instant Payments for Re-Characterizations

Some re-characterizations may feature an instant payment, or an instant payment along with a smaller payout as opposed to the full re-characterization payout amount. For example, if re-characterizing a bet would result in a Payout Amount A, before the re-characterization is accepted, a player might instead be offered Payout Amount B (some number less than A) should the re-characterization result in a win, and a small Instant Payment C paid before the re-characterization is resolved (with amount A being perhaps larger than the sum of B and C). For example, a player would like to re-characterize to "Two in a Row." The system indicates that if the player is successful, he should be paid $4,235. However, before the bet is book, the player is offered a $50 instant cash payment to accept only $4,000 should he indeed win the "Two in a Row" re-characterization.

Dead Chip Tracking

As described, chips and/or tokens of the present invention may be "dead" or non-cashable (i.e., have no value until they are wagered at least once, at which point they may be redeemed for their face value). In some embodiments, CPU 184 may track the dead chips provided to and/or used by each a player. This data may then be used for various purposes. For example, the house can determine a dead chip rebate owed to a player, and offer the player an incentive to continue wagering so as to diminish the rebate.

Game Play Timer

As deciding between a plurality of re-characterization options may slow down play, the house may incorporate a play timer or countdown meter. For example, any of the monitors described herein (a large public tote board, a small player screen) may indicate a decrementing timer for each round of betting. Bets may not be allowed after the timer concludes (the dealer and/or monitors signal, "No more bets"). Such timers may be adjusted or toggled off altogether if deemed appropriate by the house.

Accumulation-Based Jackpots and Progressives and Bonuses

Through playing a game featuring bet re-characterizations, players may win jackpots in a variety of manners. Triggering conditions for winning such a jackpot may be based on the player's ability to build toward a goal over a plurality of hands. For example, during a period of play (e.g., one shoe, 50 hands, 100 cards, 30 minutes), a player may accumulate one or more game element(s) (e.g., a number of winning hands, a number of cards, a point value derived from a margin of victory, etc.). If the player accumulates enough of the game element (e.g., 300 points) during the period of play, he may win a jackpot. Of course, through mathematical simulation, an appropriate relationship between the number of accumulated elements and period of play may be determined such that a desirably low probability of hitting the jackpot is achieved. The count may reset after the period is complete, with a new period then beginning.

In one specific baccarat example, each time the player wins a hand, the value of the winning side is added to a point total (e.g., the player wins 6-5, and 6 points are added to the player's point balance displayed by a small player screen, which now totals 81). If the point total exceeds a threshold, the player may win a jackpot. For example, the player may win a jackpot if he accumulates 250 points in 88 hands. If the player correctly wagers on "Tie," both sides may be added to the point total (e.g., 8 points are added for an outcome of 4-4).

A player winning a bet through re-characterization may be awarded points on a different scale. A player using "Switch Sides" and winning might only be awarded half the value of the winning hand in points.

Achieving various point totals on the way toward accumulating a target jackpot-awarding point total may provide smaller awards. In one example, a player achieves exactly 88 points (e.g., her point total "lands" exactly on "88" after winning a hand) and is accordingly awarded 8 bonus points. In another example, after achieving 100 points, the player's next bet is doubled for free, up to a certain maximum.

In another specific baccarat example, a number of player wins is tracked across a set number of rolling hands (e.g., 88). Once the player has played 88 hands, each new result removes the earliest result still remaining in the pool of results. If at any time the player achieves a certain number of wins within 88 hands (e.g., 65 wins), she may be paid the jackpot. Prizes might conversely be awarded for losing a certain number of hands. Again, wins achieved through re-characterization may not provide full credit toward this count (e.g., each "Switch Sides" win counts as half). Or, each time the player uses "Switch Sides" or some other re-characterization, the house may increase the target number of winning hands (e.g., from 65 to 66). The player's count may persist in a database from session to session. In some embodiments, the player may be able to "reset" his count (e.g., through an option of a monitor 170) whenever desired.

The jackpot amount may be "progressive" (the size increases as it is funded with a fraction of all bets), and may even be a "personal progressive" (the size increases as it is funded with a fraction of all bets attributed to a specific player).

In one embodiment, the contribution made to a progressive jackpot may be altered for re-characterized bets. In other words, while placing a standard bet may increase the size of the progressive jackpot by a small fraction of the wager (e.g., 1%), placing a re-characterized bet may increase the size of the progressive jackpot by a smaller or larger fraction (e.g., 0.05% or 2%). Thus, the player's personal progressive may climb at different rates as the player places bets of different amounts, with a mix of standard and re-characterized bets.

Jackpot information (size, accumulated game elements, contributions to a progressive jackpot pool) may be displayed to a player, perhaps via monitors 170. Progress toward an accumulation-based award may be depicted in graphical form (a bar fills as the player accumulates points).

Instead of a jackpot, the player may receive a bonus or rebate. For every re-characterized or late bet the player places, the player is awarded a percentage of the bet (e.g. 0.5 or 1%) into a bonus balance. This bonus balance accrues until the player requests to redeem the balance. The player may then be provided chips equal to the bonus balance for use in the game, or to have as winnings. As noted elsewhere, a token may be used during the cash out procedure so that the table 150 performs the proper accounting for the player. This bonus may be persistent for the shoe for anonymous players. For players for whom player tracking information is known, the bonus may be deferred across a plurality of gaming sessions, awarded instantly, or otherwise distributed. Likewise, the amount of the bonus may be scaled according to the level of the player. For example, gold players may receive a higher bonus than silver players, but less than diamond players. Note that this bonus may be provided only for re-characterizations or late wagers where the player adds value to the initial wager.

In a variation of this embodiment, the bonus amount may be used only to place advantage bets. Such advantage bets might have a small positive expected value. The advantage bets may be bet re-characterizations or late wagers with a smaller house edge, or other technique to make the wager more attractive to the player and encourage the player to recycle the bonus through additional wagers.

Other Times for Bets

While the present disclosure has focused on bet re-characterization and late wagers after the initial four cards have been dealt, the disclosure is not so limited. Rather, the re-characterized wager or late bet may occur after any card has been dealt. Odds may change for such wagers as each card is dealt. For example, a late bet may be accepted after the first card is revealed on the banker hand and again after the second card is revealed on the banker hand. Another late bet may be accepted after the player hand is revealed. Still other times may be used if desired.

FINAL EXAMPLE

Figure 20:
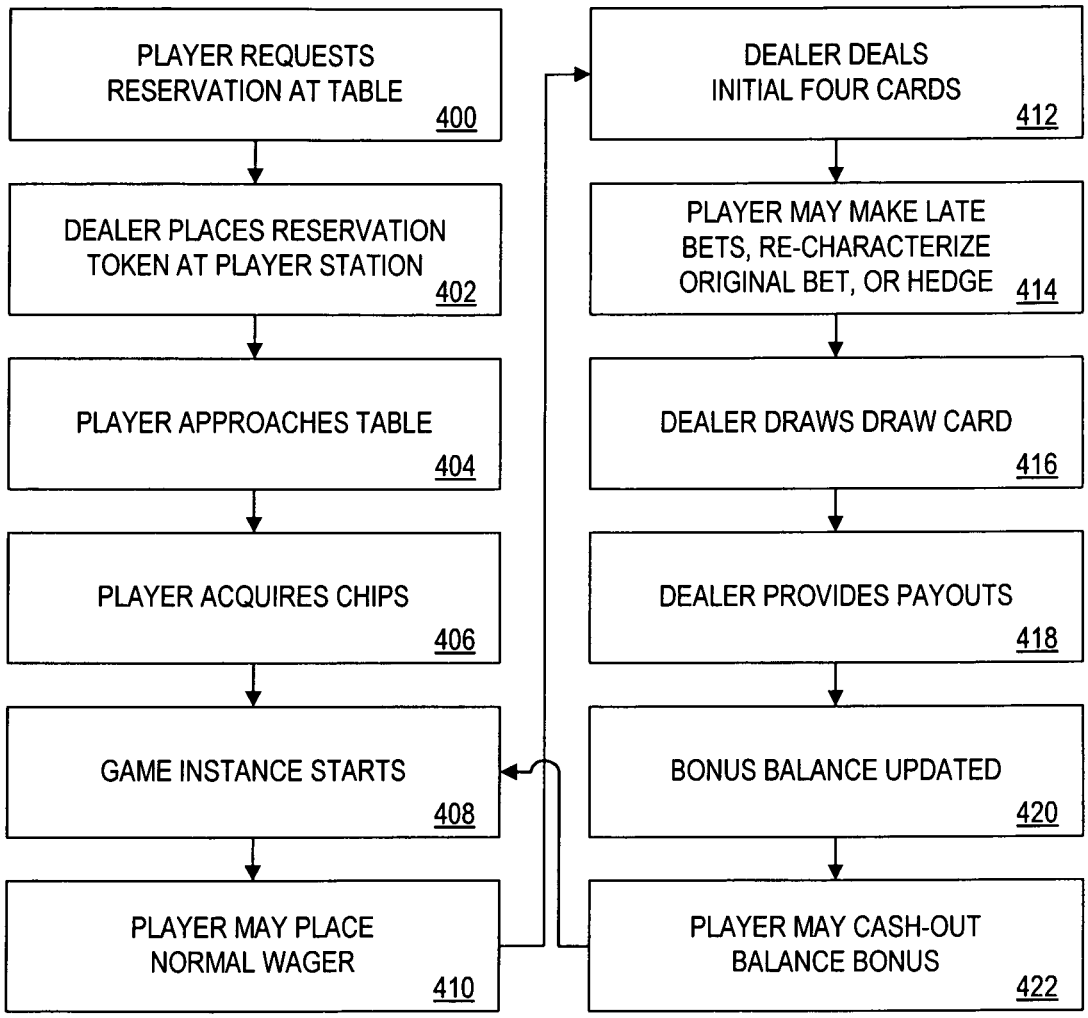
FIG. 20 illustrates a particularly contemplated method of the present disclosure.

While the above discussion ambitiously describes many variations that may be implemented, there is a currently contemplated embodiment that draws several of these variations together into a single cohesive whole. This embodiment is described with reference to the flow chart of FIG. 20.

A player initially speaks to a member of the gaming establishment staff such as a personal concierge and requests that a chair at the player's favorite table be reserved for the player (block 400). The concierge alerts the pit boss or other appropriate personnel associated with the table, such as by making a phone call, and the dealer or croupier is informed of the reservation request. The dealer places a reservation token at an appropriate player station 156 (block 402). The reservation token may be positioned on any RFID interrogator associated with the particular player station 156. The interrogator detects the reservation token and deactivates the player monitor 192. Alternatively, the player monitor 192 may display a screen stating "Reserved" or the like. The deactivation or reserved status continues until the reservation token is removed from the player station 156.

The player eventually approaches the table 150 (block 404). The personal concierge may inform the dealer that this is the player for whom the reservation was made; the dealer may recognize the player; or some other technique may be used to verify that the player is indeed the player for whom the reservation was made. For example, a player identifier may have been provided as part of the reservation making process (entered by the dealer through the dealer display 158), and when the player arrives and inserts a player tracking card, the reservation is accessed, verified, and released.

The player acquires the RFID chips 172 from the dealer for value (block 406). The player may also review the monitor 170 to evaluate how the shoe is trending. Likewise, if the player has particular trends that the player desires to track, the player may use the player monitor 192 to query the CPU 184 for information regarding the same. For example, the player may query how many times the banker hand has won with a natural 8 or 9. The player may likewise observe a few hands to see how the table is playing. Making this information available may help allay the superstitions of some types of players and in general does not provide enough information for card counters to gain an unfair advantage.

At some point the player is ready to play, and a game instance starts (block 408). The player may place a normal wager (block 410). That is, the player may place a wager on the banker hand, the player hand, or a tie as is normal. Additionally, the player may place a banker pair or player pair wager. The table 150 may have appropriate indicia for each of these bets. Alternatively, the pair wagers may be proposition bets with their own RFID tokens that are detected by an appropriate interrogator.

Once all the bets have been made, the dealer deals the initial four cards (block 412). The cards for the player hand may be handed to the player with the highest "player hand" wager, or put in a designated spot on the table 150 as desired. Tradition may dictate that the cards go to the player, although security concerns suggest that a designated spot on the table 150 may be preferred. The shoe 164 reads the cards as they are dealt, effectively informing the CPU 184 what cards have been dealt to what position. Note that the shoe 164 may also report burnt cards as well so that the CPU 184 may be informed of which cards have been pulled from the shoe 164 at any given time.

The cards are revealed. If the hands are not natural or pat hands, the player may make a late bet (if the player made no original wager), re-characterize her wager, or make a hedge bet (block 414). To assist the player, the player monitor 192 may provide information about what any wager would pay. Additionally, a slider or other mechanism may be provided through the player monitor 192 so that the player may peruse one or more hypothetical bet(s) to determine what the payout would be for such a hypothetical bet. Note that since the CPU 184 "knows" what cards have been dealt to what position as well as the composition of the shoe 164, the CPU 184 may calculate an expected value for the hand and a proposed wager. The payouts published on the player monitor 192 may be the expected value minus the house edge and/or the commission as appropriate.

The player makes such a bet by orally stating the player's desire for the bet to the dealer while providing any additional funds required by the new wager. The dealer places an RFID token on the player's wager. The interrogator detects the RFID token (along with the new chips, if any) and reports to the CPU 184. The CPU 184 updates the player monitors 192 with the revised wager information.

The dealer deals the draw cards (block 416). The CPU 184 records what cards were dealt to which hand by virtue of the report from the shoe 164 and thus may determine a winner and payouts for each position. The payouts may be provided on the dealer monitor 158, the monitor 170, and on each player monitor 192. The dealer then provides payouts as appropriate (block 418). The payouts may be positioned over an interrogator so that the CPU 184 may more readily track where the chips 172 are provided and confirm that the correct payouts were made.

If the player provided additional funds for the wager at block 414, the player's bonus balance may be updated (block 420). The round concludes and the player may cash out the bonus balance as desired (block 422). If the player does cash out the bonus balance, the dealer may place the chips on an interrogator along with a bonus balance token so that the CPU 184 is informed that the payout corresponds to a bonus balance and decrements the bonus balance accordingly.

A more concrete example is provided. At 5 PM while at supper, the player tells his waiter that he would like a reservation at Table 1138 for 8 PM. The waiter relays this information to a pit boss, who informs the dealer at Table 1138 to place a reservation token at one player position. The CPU 184 detects the reservation token and flashes "Reserved" on the player monitor 192. The player enjoys his meal in a leisurely fashion and meanders to Table 1138, arriving shortly before 8 PM. The player sits down and the dealer removes the reservation token from the player position. The player hands the dealer $500,000 and receives chips 172 for this amount. The dealer has just prepared a new shoe, but the player studies the trends on the monitor 170 while the dealer is preparing the chips. A strong banker trend is revealed from the previous shoe.

Armed with his chips, the player watches the dealer burn three cards and then watches the first hand be dealt. The shoe 164 reports each of these cards, including the burn cards to the CPU 184. It is a 4-8 player versus a 5-7 banker (note that for this example, the disclosure will always list the player hand first unless otherwise indicated). In other words, a 2-2 tie. The player does not feel comfortable and lets the hand pass by without placing a wager. The player hand draws a 5 and the dealer draws a 10. The player hand wins.

The player watches another hand be dealt. The hand is a 6-A versus a 5-Q. The player is becoming confident that the shoe is going to trend player and examines the player monitor 192. The player monitor 192 says that a late bet player wager pays 140 per 1000 and a late bet banker wager pays 4660 per 1000. The player places a late wager of $50,000 on the player. The player does this by informing the dealer of the player's desire and tendering $50,000 in chips. The dealer places a late action token on the chip stack. The interrogator detects the chips and the late action token and reports to the CPU 184. The dealer deals a card to the banker hand, and it is a 10. The player hand wins 7-5. The player wins $6,770 on his wager and receives a $250 rebate to his bonus balance for the late bet. Note that the dealer places the $6770 on the player position interrogator, which detects the payout. The interrogator reports to the CPU 184, which compares the payout to what the dealer was supposed to payout to the player and provides an alarm if there is a discrepancy. Once cleared by the CPU 184, a notice is provided to a monitor or the dealer may indicate to the player that it is safe for the player to retrieve his winnings.

More confident, the player bets $75,000 on the player hand for the third hand of the shoe. The interrogator detects the initial wager and shows the wager on the dealer monitor 158 and the player monitor 192. The dealer deals a 6-J to the player position and a K-3 to the banker position. Exultant that the player is guessing the trend correctly, the player examines the player monitor 192. The monitor 192 states that for a raise, the house will pay 260 per additional 1000 wagered; for a hedge bet, the house will pay 2790 per 1000 wagered; and for a switch (to the banker) of the original $75,000 bet, the house will pay $364,540. The player uses the slider bar on the monitor 192 to determine that a raise to $90,000 would pay $78,900. The player finds this attractive and indicates to the dealer that the player would like to raise his bet to $90,000 while tendering the additional $15,000 in chips. The dealer deals a 6 to the banker hand, resulting in a 6-9 loss for the player. However, the player's bonus balance increments to $700 for the late action.

The player is still confident that the shoe will trend player, so places another $75,000 wager on the player hand. The CPU 184 detects the wager and provides the appropriate updates to the monitors. The dealer deals a J-8 and 9-6. The player hand wins on the natural 8 to the banker 5. The player wins $75,000. Again, the payout is detected by the appropriate interrogator.

Feeling bold, the player raises his initial wager to $100,000, which is dutifully detected by the interrogators and reported to the CPU 184. The dealer deals a 10-3 versus a 6-7 for a 3-3 tie. The player examines the player monitor 192 and sees that a raise will pay 920 per 1000, a hedge will pay 850 per 1000 and the switch sides option is grayed out/not available. Dubious, the player states that he desires to place a $5000 hedge bet while tendering the appropriate chips. The dealer places a hedge token on the new chip stack. The interrogators detect the new chip stack and token and update the CPU 184 accordingly. The player hand draws a 10 and the banker hand draws a 5, so the banker hand wins 3-8. The player loses his original $100,000 bet, but wins on the hedge bet. So the dealer collects the $100,000 and pays $104,620 on the hedge bet. The player's bonus balance increments to $1220.

Reversing himself the player now wagers $100,000 on the banker hand. The dealer deals a 2-A versus a 3-A. The player examines the player monitor 192 seeing that a raise pays 420 per 1000, a hedge pays 1830 per 1000 and switching (to player) pays 264,610 on the original 100,000 wager. The player decides to stay put. The dealer deals a K to the player hand resulting in a 3-4 win for the banker hand. The player collects his $95,000 as the 5% commission has already been calculated and the win reduced accordingly.

The player places another $100,000 on the banker hand. The dealer deals a Q-6 versus a K-A. The player monitor 192 shows that a raise pays 2790 per 1000 and the hedge pays 260 per 1000. The player places a 10,000 hedge bet. The dealer deals a 5 to the banker hand resulting in a 6-6 tie. The player gets both bets back and the player's bonus balance increments to $1770.

The player places another $100,000 on the banker hand. The dealer deals a A-K versus a 7-7. The player sees that switching pays 220,890. The player decides to make the switch (to player) informing the dealer of the same. The dealer moves the wager stack to the player position and places a switch token on the moved stack. The interrogators detect this and update the CPU accordingly. The dealer deals a 7 to the player and a 4 to the banker. Another tie.

Frustrated with this dealer, the player indicates that he desires to cash out and be done. The player informs the dealer, who places the 1770 from the bonus balance along with a bonus token on the interrogator. The CPU 184 updates the bonus balance (i.e., decrements to zero). and the player walks away a winner.

Rules of Interpretation & General Definitions

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, Local Area Network (LAN), Wide Area Network (WAN), or Ethernet (or IEEE 802.3), Token Ring, or via any appropriate communications means or combination of communications means. Exemplary protocols include but are not limited to: BLUETOOTH™, TDMA, CDMA, GSM, EDGE, GPRS, WCDMA, AMPS, D-AMPS, IEEE 802.11 (WI-FI), IEEE 802.3, SAP, SAS™ by IGT, SUPERSAS™, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cellular networks, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. A gaming table comprising:

a playing surface comprising:

a banker hand area;

at least one player station comprising a player display; and a plurality of RFID interrogators adapted to detect placement and movement of RFID chips and re-characterization tokens;

a shoe from which cards are dealt; and a control system operatively coupled to the player display, the shoe, and the plurality of RFID interrogators and adapted to: receive information about at least one of the cards dealt from the shoe;

determine that a first bet has been placed by a player associated with the player station;

dynamically determine, based on at least one factor relevant to the first bet, each of a modified odds and a corresponding modified payout for a particular bet re-characterization of the first bet, wherein at least one bet re-characterization is available via the control system, and further wherein the control system is operable to suppress the at least one bet re-characterization available via the control system based on at least one of the first bet and the at least one of the cards dealt;

display the available odds and the corresponding modified payout for the particular bet re-characterization on the player display, thereby making the particular bet re-characterization available to the player;

detect placement of a bet re-characterization token with at least one RFID interrogator of the plurality of RFID interrogators, wherein the bet re-characterization token corresponds to the particular bet re-characterization and further wherein the bet re-characterization token has no monetary value as a wagering chip aside from being indicative of a re-characterization wager being placed;

display an acknowledgment of that the first bet has been re-characterized into a second bet in accordance with the particular bet re-characterization based at least in part on the placement of the bet re-characterization token and at the modified odds;

determine whether the player wins the re characterized second bet; and inform a dealer of a payout for the player.

2. The gaming table of claim 1 wherein the control system is further adapted to detect a late bet by the player.

3. The gaming table of claim 1 wherein the playing surface reflects a baccarat playing surface.

4. The gaming table of claim 1 further comprising a dealer station comprising a dealer display.

5. The gaming table of claim 4 wherein the control system is further adapted to display payout information to the dealer through the dealer display.

6. The gaming table of claim 1 wherein the control system is further adapted to suppress at least one of the at least one available bet re-characterizations based on at least one of: the first bet and cards dealt.

7. The gaming table of claim 1 wherein the control system is further adapted to provide a bet slider through the player display, wherein the bet slider allows the player to determine a hypothetical payout based on a hypothetical bet re-characterization.

8. The gaming table of claim 1 wherein the control system is further adapted to determine cards remaining in the shoe based on cards dealt.

* * * * *